US012270255B1

(12) United States Patent
Dunbar et al.

(10) Patent No.: US 12,270,255 B1
(45) Date of Patent: Apr. 8, 2025

(54) MULTIPLE SELECTABLE PRESSURE DRIVEN DEVICES ON A DRILL BIT

(71) Applicant: Halliburton Energy Services, Inc., Houston, TX (US)

(72) Inventors: Bradley David Dunbar, Conroe, TX (US); Robert Warner, Conroe, TX (US); Matt Barnes, Conroe, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/409,551

(22) Filed: Jan. 10, 2024

(51) Int. Cl.
*E21B 10/43* (2006.01)
*E21B 12/00* (2006.01)
*E21B 44/00* (2006.01)

(52) U.S. Cl.
CPC ..... *E21B 10/43* (2013.01); *E21B 12/00* (2013.01); *E21B 44/005* (2013.01)

(58) Field of Classification Search
CPC ..... E21B 10/43; E21B 12/00
See application file for complete search history.

(56) References Cited

U.S. PATENT DOCUMENTS

| | | | | |
|---|---|---|---|---|
| 6,142,250 | A * | 11/2000 | Griffin | E21B 44/005 175/426 |
| 7,971,662 | B2 | 7/2011 | Beuershausen | |
| 8,191,651 | B2 | 6/2012 | Hall et al. | |
| 10,472,897 | B2 | 11/2019 | Dunbar et al. | |
| 11,111,730 | B2 | 9/2021 | Chanpura et al. | |
| 11,293,232 | B2 | 4/2022 | Dunbar | |
| 2015/0322725 | A1* | 11/2015 | Fuller | E21B 34/06 175/269 |
| 2016/0032658 | A1* | 2/2016 | Jain | E21B 17/1014 175/27 |
| 2018/0163480 | A1* | 6/2018 | Evans | E21B 10/325 |
| 2020/0165876 | A1 | 5/2020 | Dunbar | |
| 2021/0270094 | A1 | 9/2021 | Propes et al. | |
| 2023/0117681 | A1 | 4/2023 | Clark et al. | |

FOREIGN PATENT DOCUMENTS

| | | | | |
|---|---|---|---|---|
| CN | 105189907 | | 6/2017 | |
| CN | 107529581 | | 1/2018 | |
| CN | 208137866 | | 11/2018 | |
| NL | 0225101 | A2 * | 11/1986 | E21B 10/62 |
| WO | WO-2016140663 | A1 * | 9/2016 | |
| WO | 2020216874 | | 10/2020 | |
| WO | 2023011681 | | 2/2023 | |

* cited by examiner

*Primary Examiner* — Cathleen R Hutchins
*Assistant Examiner* — Ronald R Runyan
(74) *Attorney, Agent, or Firm* — Michael Jenney; C. Tumey Law Group PLLC

(57) ABSTRACT

Systems and methods for downhole drilling and, more particularly, hydraulic control systems and methods for hydraulically locking and unlocking moveable elements of a drill bit are provided. A drill bit may include a body; a moveable element secured to the body, wherein the moveable element is configured to extend or retract from a surface of the drill bit; a communication channel from the moveable element to a bore in the body; and a hydraulic control system at least partially disposed in the body, wherein the hydraulic control system is configured to at least provide fluid communication from the bore to the communication channel to thereby lock or unlock the moveable element.

20 Claims, 20 Drawing Sheets

MULTIPLE SELECTABLE PRESSURE DRIVEN DEVICES ON A DRILL BIT

BACKGROUND

Drill bits are used to form wellbores in subterranean formations for recovering hydrocarbons such as oil and gas lying beneath the surface. Examples of such drill bits include rotary drill bits (e.g., fixed cutter drill bits, roller cone bits, hybrid bits, etc.), hole openers, reamers, and coring bits. Generally, drill bits are mounted on the ends of drill strings, which may be several miles long. At the surface of the wellbore, a rotary table or top drive may turn the drill string, which rotates the drill bit to penetrate the subterranean formation. Additionally, during drilling operations, drilling strings generally apply weight on bit (WOB) to drive the drill bits to penetrate the subterranean formations. As such, contact between drill bits and the subterranean formations apply various forces (e.g., compression and bending forces) on drill bits. Such forces may wear or fatigue the drill bit and/or cutting elements secured to the drill bit. Sensors may be used to collect and transmit data indicating forces on the drill bits, which may be analyzed and used to limit the amount of forces applied to the drill bit.

Drill bits may include one or more depth of cut control ("DOCC") elements configured to control the aggressiveness of the drill bit, and thus the amount that a drill bit cuts into a geological formation. However, conventional DOCC elements are disposed on external surfaces of drill bits and remain stationary during the entire drilling run. Thus, conventional drill bits with DOCC elements may not control the depth of cut of the cutting tools to the desired depth of cut for the entirety of the drilling run and may unevenly control the depth of cut with respect to each of the cutting elements on the drill bit. This uneven depth of cut control may allow for portions of the DOCCs to wear unevenly. Also, uneven depth of cut control may cause the drilling bit to vibrate, which may damage parts of the drill string or slow the drilling process. Additional elements disposed on a drill bit, such as gauge elements, also may be disposed on external surfaces and typically remain fixed during the entire drilling run.

BRIEF DESCRIPTION OF THE DRAWINGS

These drawings illustrate certain aspects of some of the embodiments of the present disclosure and should not be used to limit or define the method.

DETAILED DESCRIPTION

Disclosed herein are systems and methods for downhole drilling and, more particularly, example embodiments are directed to hydraulic control systems and methods for hydraulically locking and unlocking moveable elements of a drill bit. For example, a drill bit may include depth of cut control elements, gauge elements, moveable blades, moveable cutting structures, or other moveable elements than can extend or retract from the drill bit. For locking and unlocking of these moveable elements, the hydraulic control systems may direct a pressurized fluid from a fluid cavity into a communication channel connected to the moveable element. The hydraulic control system may lock the fluid in the communication channel from traveling back into the fluid cavity to provide a locking force for the corresponding moveable element extended from the surface of the drill bit. The hydraulic control system may be configured to direct lock the pressurized fluid into communication channels for two or more of the moveable elements so it can be used for locking or unlocking of multiple moveable elements.

The hydraulic control system may include sensors for monitoring of downhole parameters. Example downhole parameters may include operational parameters, such as pressure, acceleration (e.g., lateral, axial, tortional), rotational speed, weight on bit, torque on bit, and bend on bit. These operational parameters may be monitored for example, to determine if the drill bit is sliding or rotating. Drilling dysfunction may be monitored by monitoring one or more downhole parameters, such as stick slip, whirl, high lateral, axial or tortional instability, or high frequency tortional oscillation. The downhole parameters may be directly or indirectly determined. In response to the measured value of the downhole parameter, the hydraulic control system may activate to lock or unlock the moveable element. For example, the measured value of the downhole parameter may be compared to a target parameter value and when the measured value is beyond a threshold value of the target parameter value, the hydraulic control system may be activated to lock or unlock the moveable element.

Figure 1:
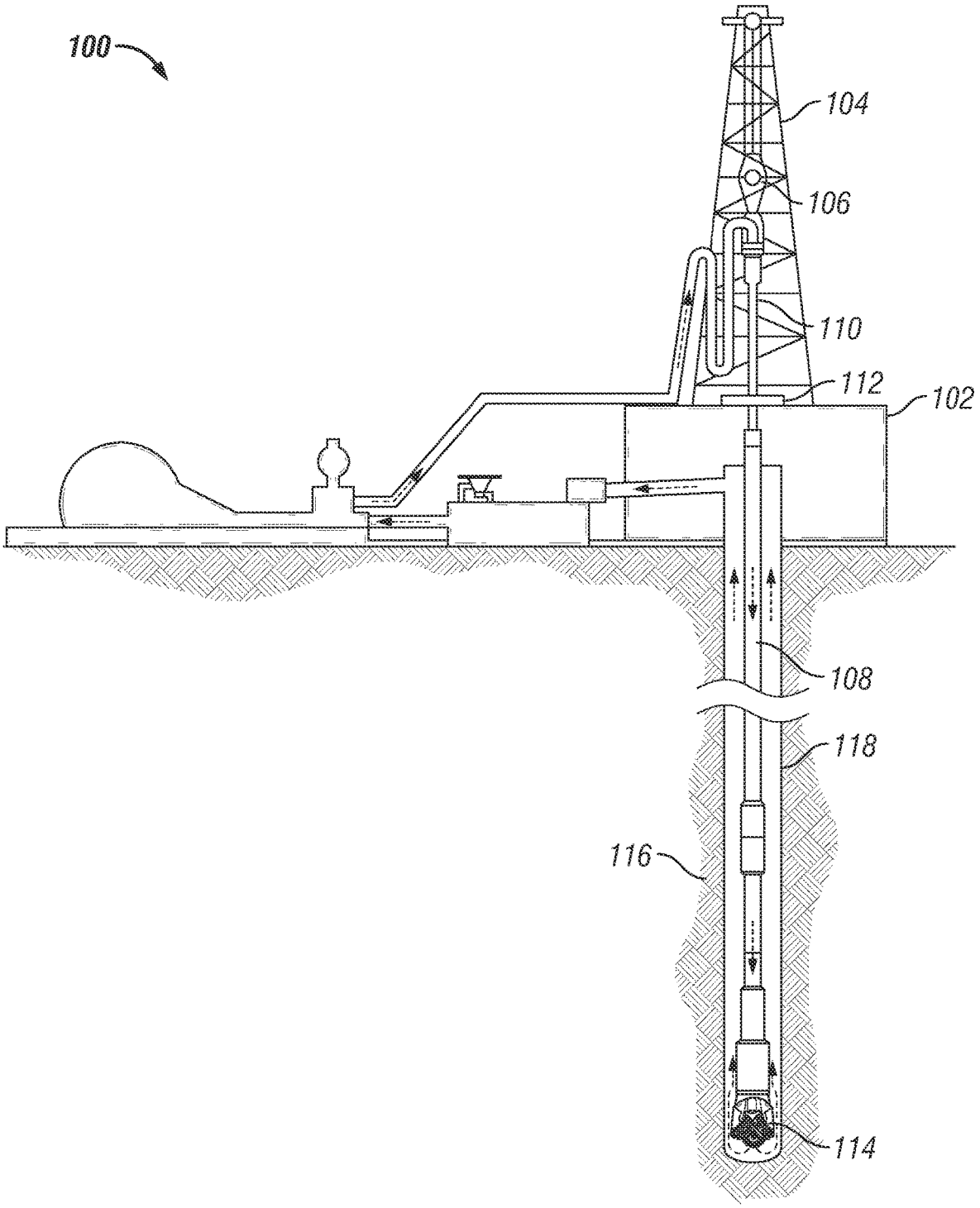
FIG. 1 illustrates an elevation view of a well system, in accordance with some embodiments of the present disclosure.

FIG. 1 illustrates an elevation view of a well system, in accordance with some embodiments of the present disclosure. It should be noted that while FIG. 1 generally depicts a land-based drilling assembly, those skilled in the art will readily recognize that the principles described herein are equally applicable to subsea drilling operations that employ floating or sea-based platforms and rigs, without departing from the scope of the disclosure. As illustrated, the drilling assembly 100 may include a drilling platform 102 that supports a derrick 104 having a traveling block 106 for raising and lowering a drill string 108. The drill string 108 may include, but is not limited to, drill pipe, as generally known to those skilled in the art. A kelly 110 may lowered through a rotary table 112 and can be used to transmit rotary motion from the rotary table to the drill string 108. A drill bit 114 may be attached to the distal end of the drill string 108 and can be driven by a downhole motor and/or via rotation of the drill string 108. As the drill bit 114 rotates, it penetrates various subterranean formations 116 to create a wellbore 118.

Figure 2:
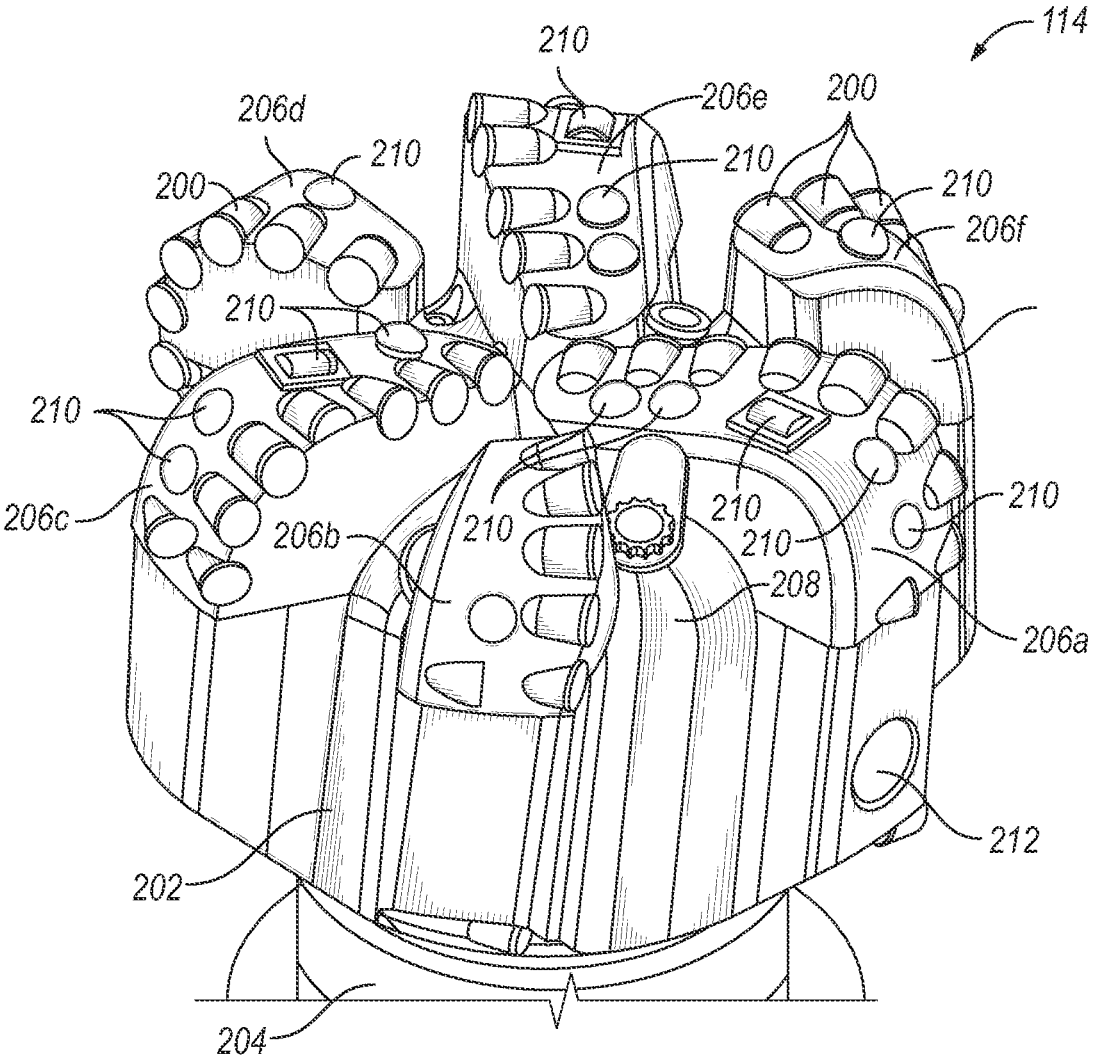
FIG. 2 illustrates a perspective view of a drill bit, in accordance with some embodiments of the present disclosure.

FIG. 2 illustrates a perspective view of a drill bit 114, in accordance with some embodiments of the present disclosure. The drill bit 114 may be any suitable downhole drilling bit (e.g., roller cone bit, hybrid drill bit, fixed cutter drill bit, hole openers, reamers, coring bits, etc.). As illustrated, the drill bit 114 may have a plurality of cutting elements 200 at fixed locations on a bit body 202 of the drill bit 114. The drill bit 114 may include a bit body 202 and a shank 204 coupled to the bit body 202. Further, the drill bit 114 may include one or more blades 206 (e.g., blades 206*a*-206*g*) extending outwardly from the bit body 202 with respective junk slots or fluid flow paths 208 disposed therebetween. As illustrated, one or more cutting elements 200 may be secured to the blades 206*a*-206*g*. As the drill bit 114 rotates, the cutting elements 200 may shear and/or break the subterranean formation 116 to form the wellbore 118 (shown in FIG. 1).

The plurality of blades 206*a*-206*g* may also include depth of cut control elements ("DOCC elements") 210. The DOCC elements 210 may be configured to protrude from a surface of the blades 206*a*-206*g*. The DOCC elements 210 may be configured to control the depth of cut of the plurality of cutting elements 130. Examples of suitable DOCC elements 210 may include a roller element, an impact arrestor, a backup cutter, and/or a Modified Diamond Reinforcement ("MDR"). Further, in one or more embodiments, the DOCC elements 210 may be configured to extend or retract between a first position in which the DOCC elements 210 protrude from the surface of the blades 206*a*-206*g* by a first distance and a second position in which the DOCC elements 210 protrude from the surface of the blades 206*a*-206*g* by a second distance, which is less than the first distance. As will be discussed in more detail below, the hydraulic control system (e.g., hydraulic control system 300 on FIG. 3) may be used to lock or unlock one or more of the DOCC elements 210, for example, at the first or second position. The DOCC elements 210 are configured, for example, to control the depth of cut of the drill bit 114 as necessitated by the wellbore conditions and the weight on bit while drilling. Further, in one or more embodiments, one or more springs (not shown) may be disposed behind the DOCC elements 210 so as to bias the DOCC elements 210 outward from the surface of the blades 206*a*-206*g*.

Furthermore, in one or more embodiments, each of the plurality of blades 206*a*-206*g* may include a gauge element 212. The plurality of gauge elements 206*a*-206*g* (only one of which is shown) may be configured to protrude from a surface of the blades 206*a*-206*g* of the drill bit 114. Further, in one or more embodiments, the gauge elements 212 may be configured to extend or retract between a first position in which the gauge elements 212 protrude from the surface of the blades 206*a*-206*g* by a first distance and a second position in which the gauge elements 212 protrude from the surface of the blades 206*a*-206*g* by a second distance, which is less than the first distance. As will be discussed in more detail below, the hydraulic control system (e.g., hydraulic control system 300 on FIG. 3) may be used to lock or unlock one or more of the gauge elements 212, for example, at the first or second position. The gauge elements 212 may engage adjacent portions of the wellbore and may be configured to enhance the stability of the drill bit 114 during both linear (i.e., vertical or lateral drilling) and non-linear (i.e., curved drilling between vertical and lateral) drilling. In one or more embodiments, the gauge elements 212 may have some, little, or no cutting capability.

Additionally, in one or more embodiments, the gauge elements 212 may be configured to extend from and retract into the bit body 202 based on engagement with adjacent portions of the wellbore (e.g., wellbore 118 on FIG. 1). Further, in one or more embodiments, the gauge elements 212 may be biased radially outward from a central axis of the drill bit 114. One or more springs (not shown) may be disposed behind the gauge elements 212, in one or more embodiments, so as to bias the gauge elements 212 outward from the central axis of the drill bit 114. Thus, in one or more embodiments, springs may be disposed behind the DOCC elements 210, the gauge elements 160, or both.

Figure 4:
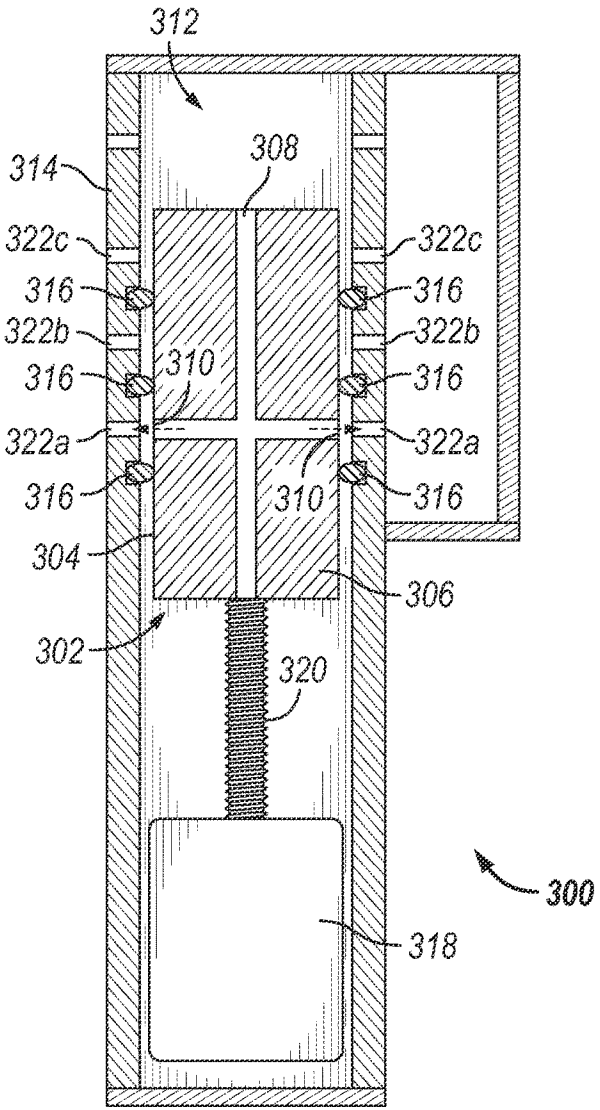
FIGS. 3 and 4 illustrate a schematic view of a hydraulic control system having a linear manifold, in accordance with some embodiments of the present disclosure.
Figure 3:
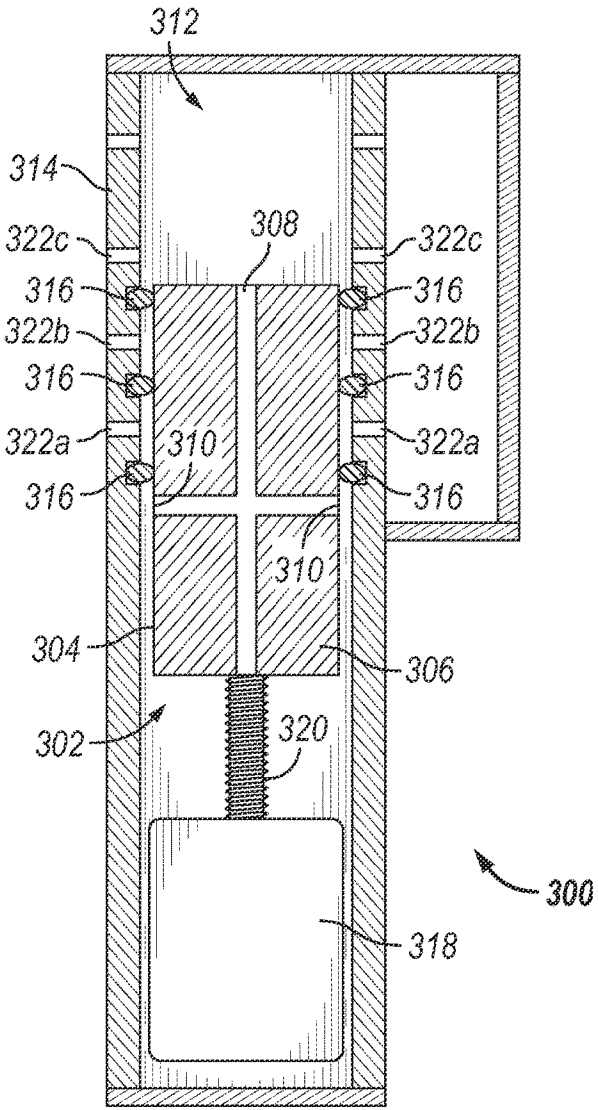

FIGS. 3 and 4 are schematic views of a hydraulic control system 300. As illustrated, the hydraulic control system 300 may include a valve element 302. The valve element 302 may include a ported piston valve 304. The ported piston valve 304 may include a piston body 306 with an inlet port 308 and exit ports 310. The inlet port 308 may receive fluid from fluid cavity 312. The ported piston valve 304 may be moveably disposed in reservoir sleeve 314. A series of spaced seals 316 (e.g., O-rings) may seal be disposed between an exterior of piston body 306 and reservoir sleeve 314. The hydraulic control system 300 may further include motor 318 (e.g., electric motor). The motor 318 may be coupled to the ported piston valve 304, for example, to linearly drive the ported piston valve 304 in fluid cavity 312 of reservoir sleeve 314. As illustrated, hydraulic control system 300 may include drive screw 320 that couples motor 318 to ported piston valve 304. Drive screw 320 may convert rotary motion of motor 318 to linear motion for linearly driving ported piston valve 304. Reservoir sleeve 314 may also include a series of ports 322*a*-322*c*, shown as first ports 322*a*, second ports 322*b*, and third ports 322*c*. The ported piston valve 304 may be moved in reservoir sleeve 314 to align exit ports 310 with selected ones of ports 322*a*-322*c*.

Operation of hydraulic control system 300 will now be described with respect to FIGS. 3 and 4. As illustrated, the ported piston valve 304 may have a first position shown on FIG. 3. In this first position, the exit ports 310 do not align with any ports 322*a*-322*c*. When desired, for example, in response to measure parameters, hydraulic control system 300 may be activated to move ported piston valve 304. As shown on FIG. 4, ported piston valve 304 may be moved to a second position with exit ports 310 aligned with first ports 322*a*. Accordingly, pressurized fluid may flow through ported piston valve 304 to first ports 322*a*. While not shown on FIGS. 3 and 4, ports 322*a*-322*c* in reservoir sleeve 314 may be aligned with one or more communication channels in drill bit (e.g., first communication channel 516 in drill bit 114 on FIG. 5) for locking moveable elements (e.g., DOCC elements 210, gauge elements 212 on FIG. 2).

Figure 5:
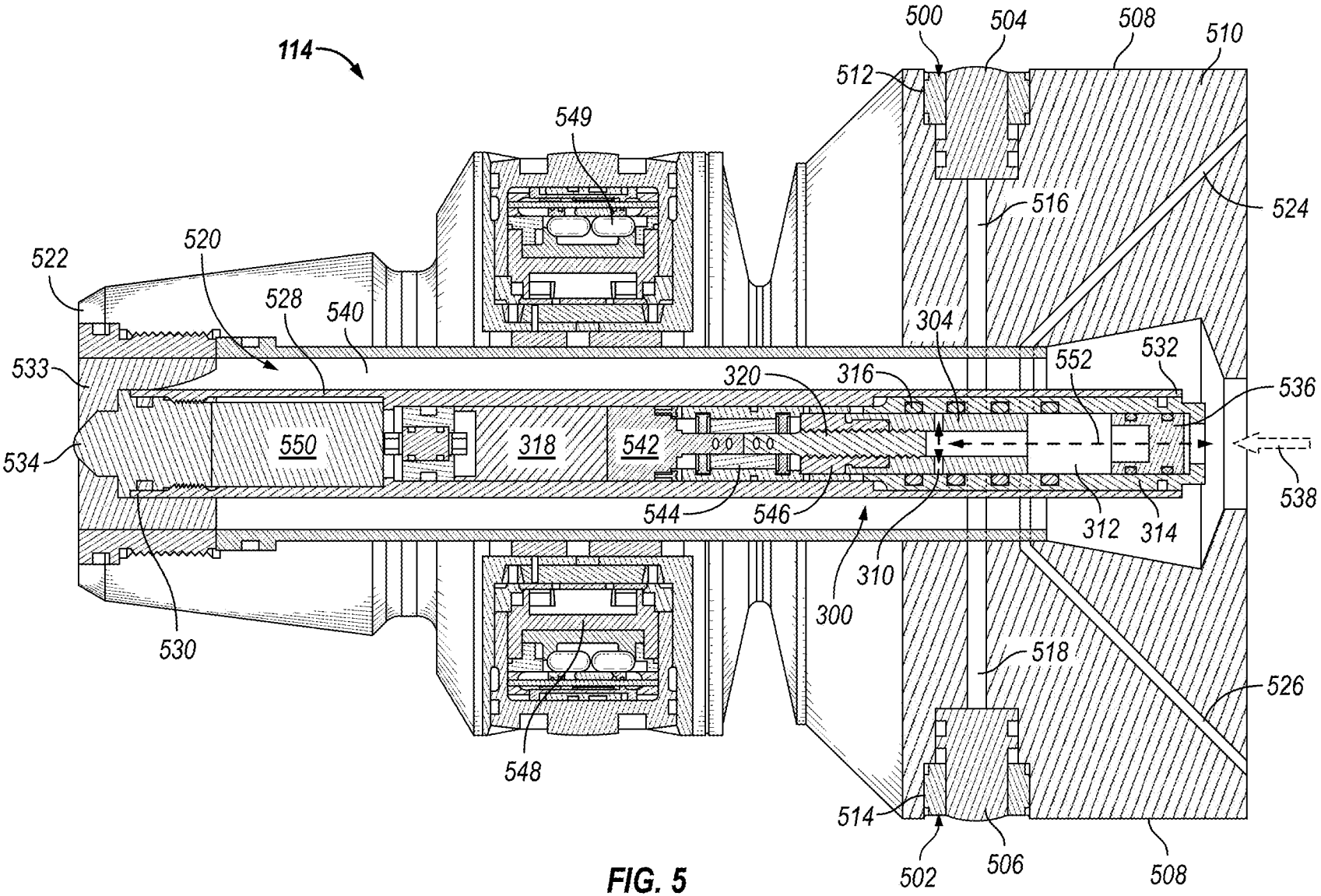
FIGS. 5-9 illustrate a cross-sectional view of a drill bit having a hydraulic control system with a linear manifold element, in accordance with some embodiments of the present disclosure.

FIG. 5 illustrates a cross-sectional view of a drill bit 114 in accordance with some embodiments of the present disclosure. As illustrated, the drill bit 114 may include two moveable elements, shown as first moveable element 500 and second moveable element 502. The first moveable element 500 may comprise a first gauge element 504, and the second moveable element 502 may comprise a second gauge element 506. Further, while only two moveable elements 500, 502 are shown, it should be understood that the drill bit 114 may include more or less than two moveable elements. It should be understood that moveable elements 500, 502 are a generalized illustration for the actual moveable elements, such as first and second gauge elements 504, 504, which may be pistons, for example. The first and second gauge elements 504, 506 may be configured to protrude from an external surface 508 of the blade 510. Further, the first and second gauge elements 504, 506 may be disposed in and coupled to respective first and second pockets 512, 514. Further, in one or more embodiments, the first and second gauge elements 504, 506 may be configured to extend or retract between a first position in which the first and second gauge elements 504, 506 protrudes from the external surface 508 of the blade 510 by a first distance and a second position in which the first and second gauge elements 504, 506 protrudes from the external surface 508 of the blade 510 by a second distance, which is less than the first distance.

As illustrated, communications channels, such as first and second communication channels 516, 518 may be formed within drill bit 114. As illustrated, the first communication channel 516 may extend between first pocket 512 and bore 520 that extends into drill bit 114 from a proximal end 522. Further, the second communication channel 518 may extend between the second pocket 514 and the bore 520. While not shown, the first and second communication channels 516, 518 may each extend to the carrier 528 to provide a fluid path from with the carrier to the first and second pockets 512, 514, respectively. The first and second communication channels 516, 518 may be filled with a fluid, such as a hydraulic fluid. Further, in one or more embodiments, the first gauge element 504 may form a seal within the first pocket 512 such that the fluid in the first communication channel 516 and the first gauge element 504 may form a piston. Thus, in or more embodiments, pressurized fluid from the bore 520 may act on the first gauge element 504 to bias the first gauge element 504 outward. Similarly, pressure from the bore 520 may be released to cause the first gauge element 504 to retract further into the first pocket 512. Further, in one or more embodiments, the second gauge element 506 may form a seal within the second pocket 514, such that the fluid in the second communication channel 518 and the second gauge element 506 may form a piston. Thus, in or more embodiments, pressurized fluid from the bore 520 may act on the second moveable element 502 to bias the second gauge element 506 outward. Similarly, pressure from the bore 520 may be released to cause the second gauge element 506 to retract further into the second pocket 514. While the preceding describes spring bias, example embodiments may include no spring bias.

Additional communication channels may be formed within the drill bit 114. As illustrated, third communication channel 524 and fourth communication channel 526 may also be formed with the drill bit 114 that each extend from the bore 520. While not shown, the third and fourth communication channels 524, 526 may each extend to additional moveable elements, such as DOCC elements, gauge elements, moveable blades, moveable cutting structures, or other moveable elements) on the drill bit 114.

The drill bit 114 may also include a carrier 528 for hydraulic control system 300. Carrier 528 may be disposed in the bore 520 and extend longitudinally in the bore 520. Carrier 528 may include a proximal carrier end 530 and a distal carrier end 532. In some embodiments, the carrier 528 may be generally cylindrical. At proximal carrier end 530, the carrier 528 may include a cap 534. An additional locking cap 533 may be secured to the proximal carrier end 530 over the cap 534, for example, to hold and position the carrier in the drill bit 114, for example, at proximal end 522 of the drill bit 114. As illustrated, a balancing piston 536 may be positioned in the carrier 528, for example, at distal carrier end 532. Even further, the balancing piston 536 may be positioned in reservoir sleeve 314 that is disposed in carrier 528. Balancing piston 536 may be acted on by external differential pressure, shown as arrow 538. As the external differential pressure 538 increases outside the carrier 528, the balancing piston 536 functions to equalize pressure inside the carrier 528 by application of this pressure to the inside of the carrier 528, thus pressuring fluid in the carrier 528. With the carrier 528 positioned in the bore 520, flow channels 540 may be formed outside the carrier 528 for the flow of drilling fluid through the drill bit 114. This drilling fluid may be exposed to pump pressure from the surface (e.g., standpipe pressure). As the pressure of this drilling fluid increases, the differential pressure 538 on the balancing piston 536 increases and, likewise, as the pressure of this drilling fluid decreases, the differential pressure 538 on the balancing piston 536 also decreases.

The drill bit 114 may also include the hydraulic control system 300. Some of the components of the hydraulic control system 300 may be positioned at least partially in the carrier 528. The hydraulic control system 300 may act to transfer pressurize fluid from within the carrier 528 into one or more of the communication channels (e.g., first communication channel 516, second communication channel 518, third communication channel 524, and fourth communication channel 526) and/or release pressurized fluid from the corresponding communication channels. As illustrated, the hydraulic control system 300 may include ported piston valve 304 that can be positioned in the reservoir sleeve 314. A series of spaced seals 316 (e.g., O-rings) may seal be disposed between an exterior of ported piston valve 304 and reservoir sleeve 314. The hydraulic control system 300 may further include motor 318 (e.g., electric motor). The motor 318 may be coupled to the ported piston valve 304, for example, to linearly drive the ported piston valve 304 in reservoir sleeve 314. As illustrated, hydraulic control system 300 may include drive screw 320 that couples motor 318 to ported piston valve 304. Drive screw 320 may convert rotary motion of motor 318 to linear motion for linearly driving ported piston valve 304. As illustrated, the motor 318 may be coupled to a gear reducer 542 for control of output speed. Motor 318 may also include one or more bearings, such as thrust bearing 544 and split bearing 546. While not shown, the reservoir sleeve 314 may also include a series of ports that can provide for communication between the reservoir sleeve 314 and the first, second, third, and/or fourth communication channels 516, 518, 524, 526. For example, the ported piston valve 304 may be moved in the reservoir sleeve 314 to align exit ports 310 with one or more selected ports in the reservoir sleeve to provide for selective communication from the reservoir sleeve 314 to the first, second, third, and/or fourth communication channels 516, 518, 524, 526, for example.

The hydraulic control system 300 may further include a control system 548 and sensors 549. Sensors 549 may sense one or more operational parameters or characteristics of the respective equipment (e.g., drill bit 114, motor 318) and communicate one or more measurements or information associated with the operational parameters or characteristics of the respective equipment, or both to motor a control system 548. For example, the sensors 549 may sense one or more of torque, weight on bit, and strain. In some embodiments, the sensors 549 may include one or more of vibration sensors, accelerometers, magnetometers, gyroscopes, and/or pressure transducers. The sensors 549 may collect data, for example, during a drilling operation, and may transmit the collected data in real-time. Any of the one or more sensors 549 may communicatively couple to control system 548 via a wired or wireless connection or directly or indirectly. The control system 548 may control one or more operational parameters or characteristics of the motor 318. For example, the control system 548 may control one or more operational parameters or characteristics of the motor 318 (for example, speed, torque, voltage, current, temperature, acceleration, deceleration, or any other parameters or characteristics). The control system 548 may comprise hardware, software or any combination thereof to process, analyze, store or any combination thereof any information received from any one or more sources, for example, any one or more of sensors 549, devices, components or equipment.

Control system 548 may comprise an information handling system with at least a processor and a memory device coupled to the processor that contains a set of instructions that when executed cause the processor to perform certain actions. In any embodiment, the information handling system may include a non-transitory computer readable medium that stores one or more instructions where the one or more instructions when executed cause the processor to perform certain actions. As used herein, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a computer terminal, a network storage device, or any other suitable device and may vary in size, shape, performance, functionality, and price. The information handling system may include random access memory (RAM), one or more processing resources such as a central processing unit (CPU) or hardware or software control logic, read only memory (ROM), and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components.

Figure 6:
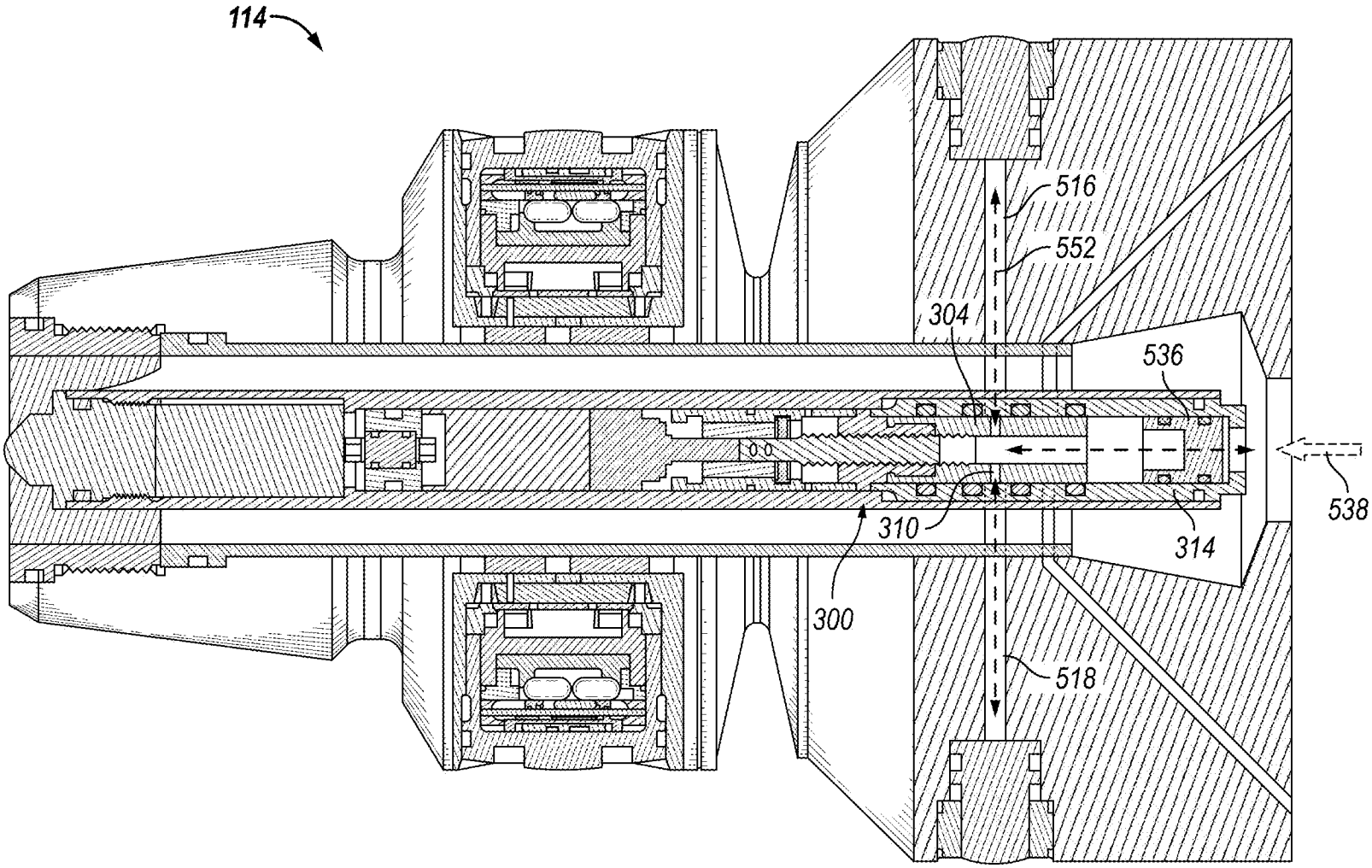

Hydraulic control system 300 may include battery 550. As illustrated, battery 550 may be disposed in carrier 528. Battery 550 may provide power to one or more components of the hydraulic control system 300, such as motor 318, control system 548, and/or sensors 549, for example, Operation of hydraulic control system 300 of drill bit 114 will now be described with respect to FIGS. 5-9. Turning to FIG. 5, the drill bit 114 is shown with no active lock of the moveable elements, such as the first gauge element 504 and second gauge element 506. As illustrated, the ported piston valve 304 of the hydraulic control system 300 is positioned such that pressurized fluid 552 is not in communication with the communication channels in the drill bit 114, e.g., first communication channel 516, second communication channel 518, third communication channel 524, or fourth communication channel 526. For example, the exit ports 310 are not aligned with any of the communication channels. When desired, for example, in response to measured parameters, hydraulic control system 300 may be activated to move ported piston valve 304. As shown on FIG. 6, the hydraulic control system 300 may move ported piston valve 304 to a second position with exit ports 310 aligned with at least one of the communications channels, e.g., first communication channel 516 and second communication channel 518. The motor 318 may linearly move the ported piston valve 304 in the reservoir sleeve 314 to align the exit ports 310 with the first and second communication channels 516, 518. With fluid communication, the fluid in the first and second communication channels 516, 518 may be pressurized such that the fluid is a pressurized fluid 552. As previously described, a differential pressure 538 across the balancing piston 536 may act to increase the pressure. Because the pressurized fluid 552 is in the first and second communication channels 516, 518, the pressure may activate the first and second gauge elements 504, 506. For example, the pressure may act on the first and second gauge elements 504, 506 to provide a biasing pressure, essentially locking them in position.

Figure 7:
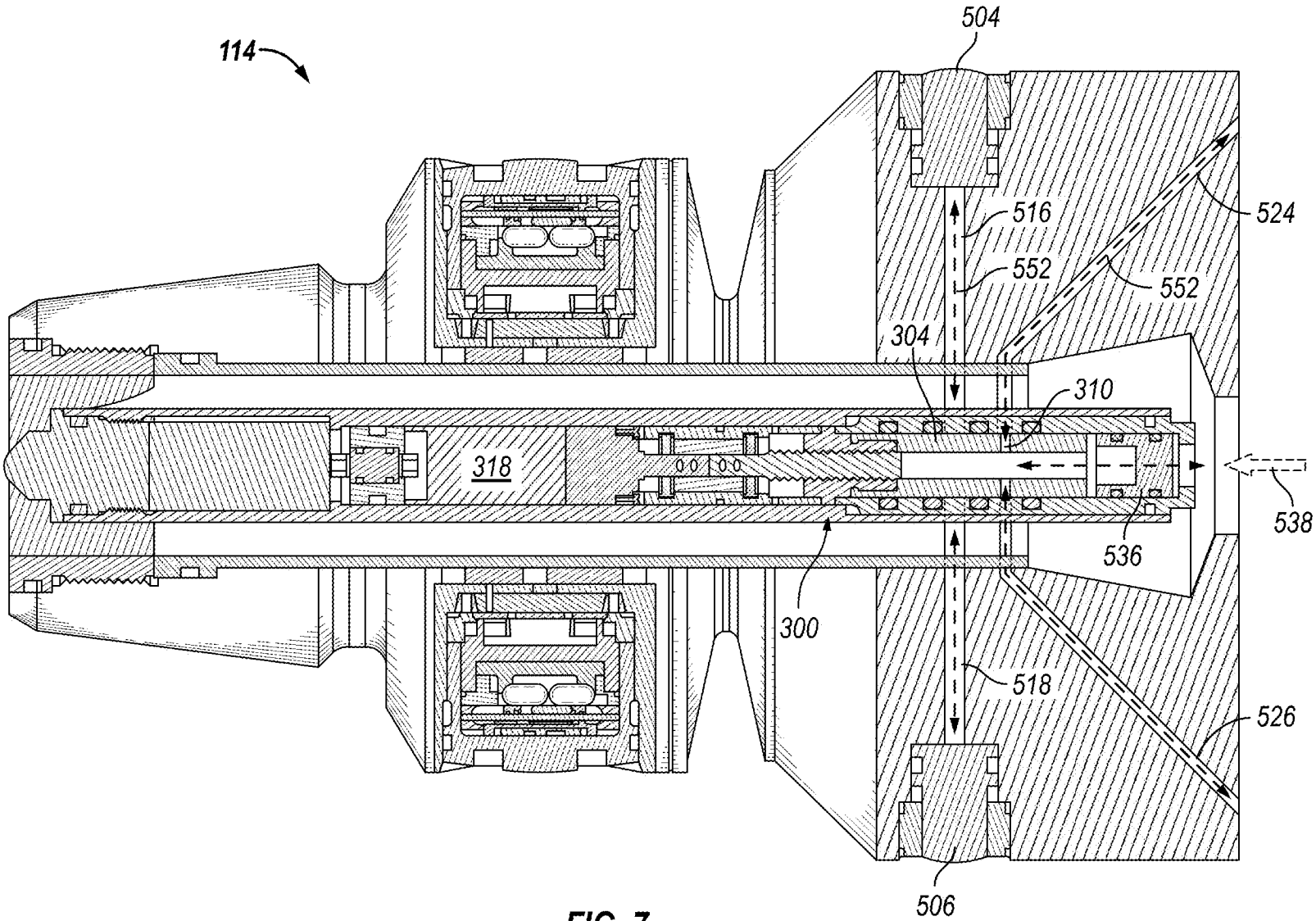
Figure 8:
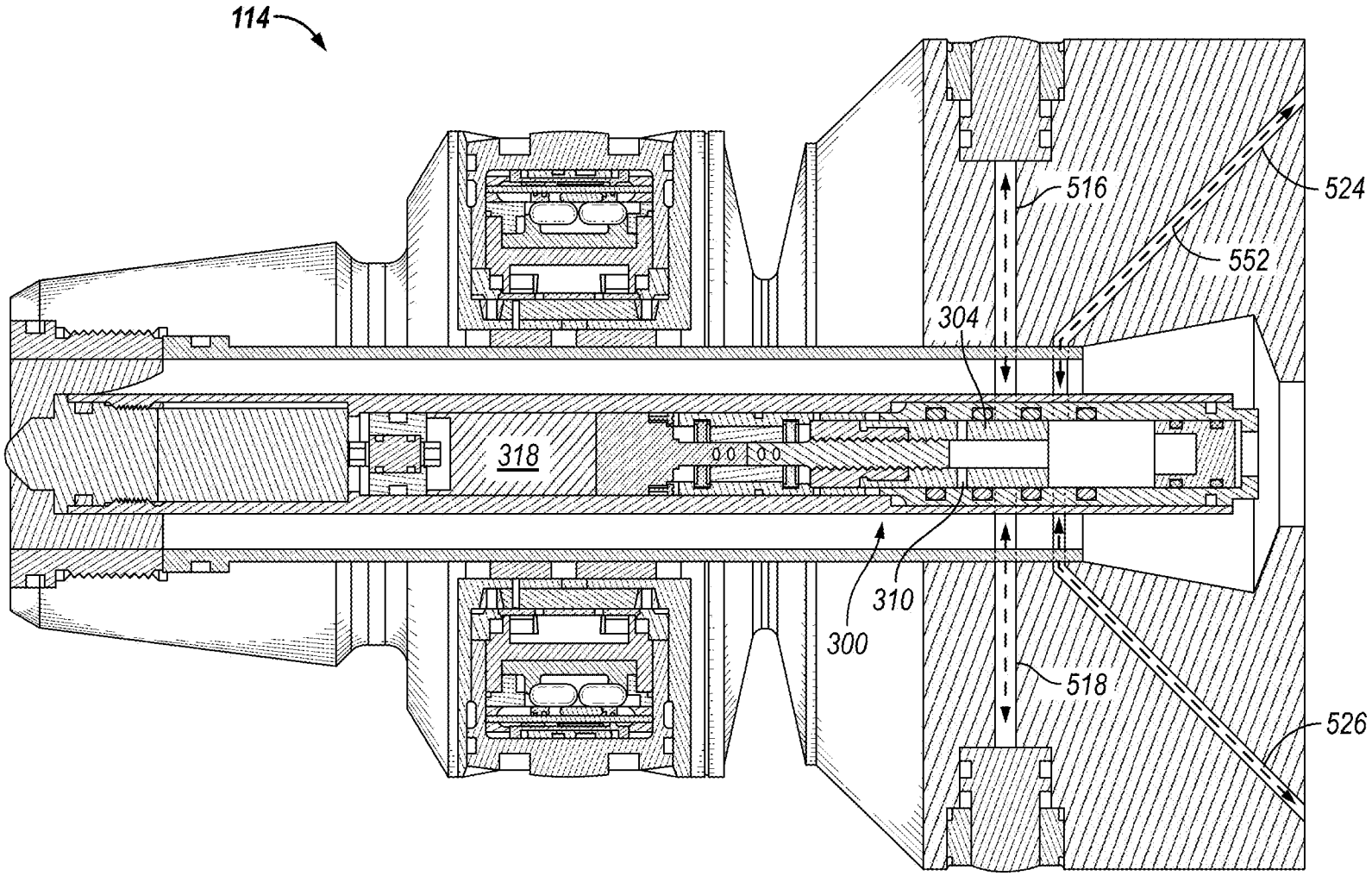

To lock additional elements, the motor 318 of the hydraulic control system 300 may move the ported piston valve 304 to a third position, as shown on FIG. 7, for example, with the exit ports 310 aligned with additional channels, e.g., third communication channel 324 and/or fourth communication channel 326. In this position, pressurized fluid 552 is also in the third communication channel 324 and/or fourth communication channel 326 from the differential pressure 538 acting across the balancing piston 536. While not shown, additional moveable elements may be associated with the third communication channel 324 and/or fourth communication channel 326 such that pressurized fluid can also provide additional biasing pressure to the additional moveable elements. In addition, the pressurized fluid 552 may be locked in the first and second communication channels 516, 518 with the exit ports 310 no longer aligned with the first and second communication channels 516, 518. As shown on FIG. 8, the motor 318 of the hydraulic control system 300 may move the ported piston valve 304 to another position where the exit ports 310 are not aligned with additional channels, e.g., third communication channel 324 and/or fourth communication channel 326, thus locking the pressurized fluid in the communication channels.

Figure 9:
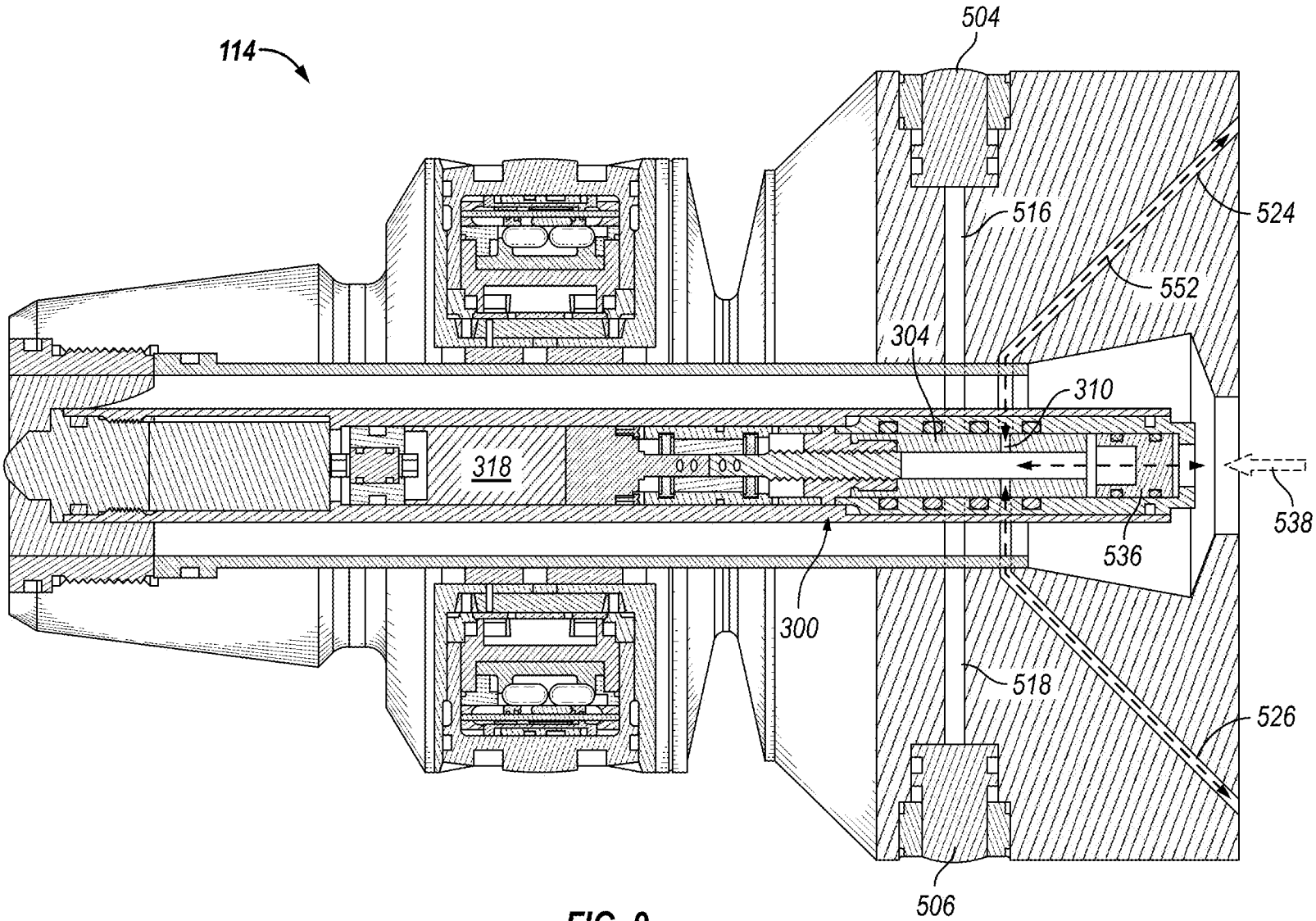

FIG. 9 illustrates use of the hydraulic control system 300 to individually lock additional movable elements (not shown) associated with the third and fourth communication channels 524, 526, in accordance with example embodiments. As illustrated, the motor 318 of the hydraulic control system 300 may move the ported piston valve 304 to a position with the exit ports 310 aligned with the third communication channel 324 and/or fourth communication channel 326. In this position, the differential pressure 538 across the balancing piston 536 communications with the third communication channel 324 and fourth communication channel 326 through the ported piston, creating pressurized fluid 552 therein that can be used to provide additional bias to the additional moveable elements (not shown) associated with the third and fourth communication channels 524, 526. However, as shown, the additional moveable elements can be individually activated, for example, without activation of the first and second gauge elements 504, 506.

Figure 10:
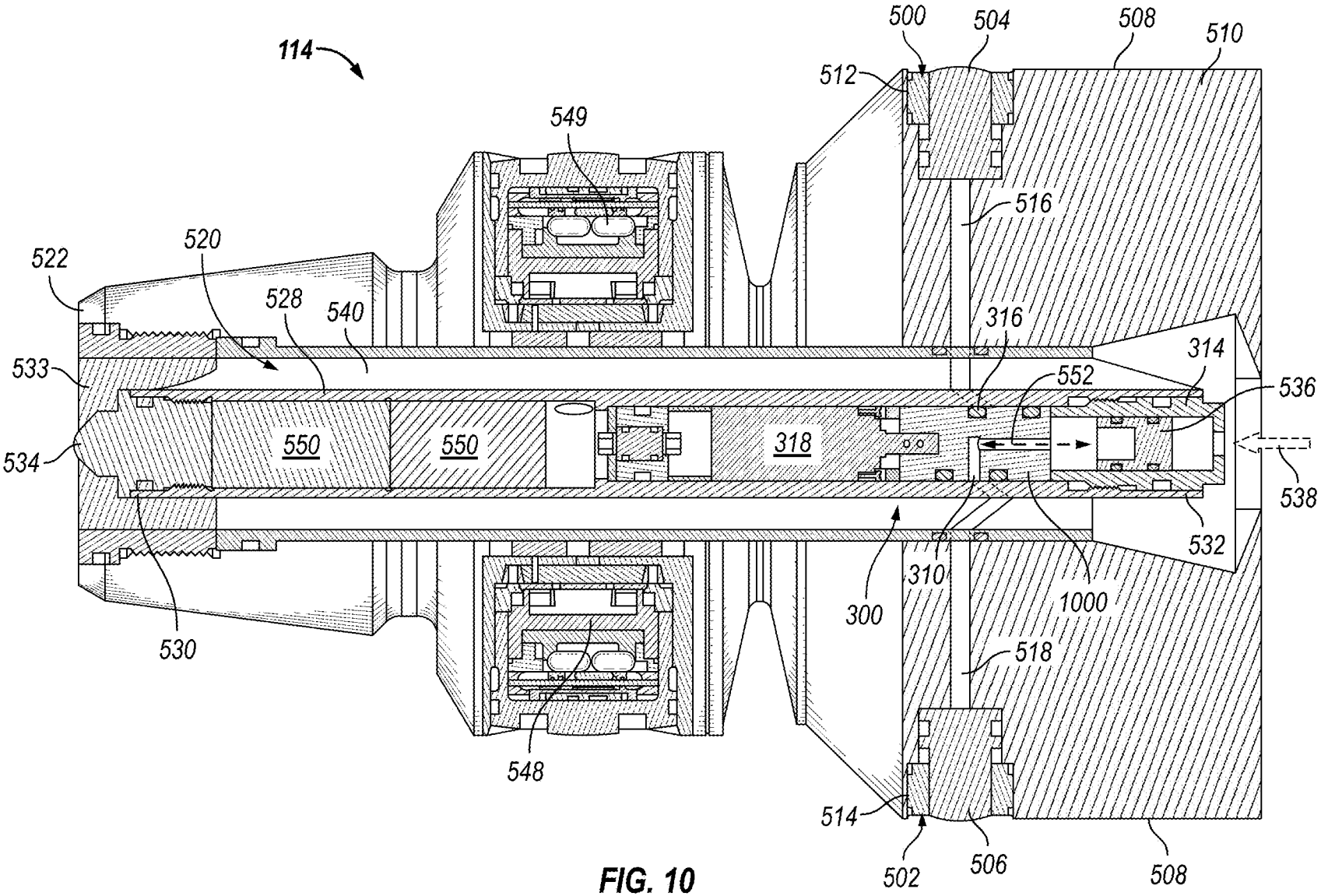
FIGS. 10-12 illustrate a cross-sectional view of a drill bit having a hydraulic control system with a rotary manifold element, in accordance with some embodiments of the present disclosure.

FIG. 10 illustrates a cross-sectional view of a drill bit 114 in accordance with some embodiments of the present disclosure. The drill bit 114 is similar to the embodiments shown on FIGS. 5-9, except that the hydraulic control system 300 of FIG. 10 includes a diagonal ported piston valve 1000 in place of the ported piston valve 304 of FIGS. 5-9. As illustrated, the drill bit 114 may include two moveable elements, shown as first moveable element 500 and second moveable element 502. The first moveable element 500 may comprise a first gauge element 504, and the second moveable element 502 may comprise a second gauge element 506. Further, while only two moveable elements 500, 502 are shown, it should be understood that the drill bit 114 may include more or less than two moveable elements. The first and second gauge elements 504, 506 may be configured to protrude from an external surface 508 of the blade 510. Further, the first and second gauge elements 504, 506 may be disposed in and coupled to respective first and second pockets 512, 514. Further, in one or more embodiments, the first and second gauge elements 504, 506 may be configured to extend or retract between a first position in which the first and second gauge elements 504, 506 protrudes from the external surface 508 of the blade 510 by a first distance and a second position in which the first and second gauge elements 504, 506 protrudes from the external surface 508 of the blade 510 by a second distance, which is less than the first distance.

As illustrated, communications channels, such as first and second communication channels 516, 518 may be formed within drill bit 114. As illustrated, the first communication channel 516 may extend between first pocket 512 and a bore 520 that extends into drill bit 114 from a proximal end 522. Further, the second communication channel 518 may extend between the second pocket 514 and the bore 520. While not shown, the first and second communication channels 516, 518 may each extend to the carrier 528 to provide a fluid path from with the carrier to the first and second pockets 512, 514, respectively. The first and second communication channels 516, 518 may be filled with a fluid, such as a hydraulic fluid. Further, in one or more embodiments, the first moveable element 500 may form a seal within the first pocket 512 such that the fluid in the first communication channel 516 and the first moveable element 500 may form a piston. Thus, in or more embodiments, pressurized fluid from the bore 520 may act on the first gauge element 504 to bias the first gauge element 504 outward. Similarly, pressure from the bore 520 may be released to cause the first gauge element 504 to retract further into the first pocket 512. Further, in one or more embodiments, the second gauge element 506 may form a seal within the second pocket 514, such that the fluid in the second communication channel 518 and the second gauge element 506 may form a piston. Thus, in or more embodiments, pressurized fluid from the bore 520 may act on the second gauge element 506 to bias the second gauge element 506 outward. Similarly, pressure from the bore 520 may be released to cause the second moveable element 502 to retract further into the second pocket 514. While not shown, one or more additional communication channels may be formed within the drill bit 114 for coupling additional moveable elements on the drill bit 114 to pressurized fluid in the carrier 528. While the preceding describes spring bias, example embodiments may include no spring bias.

The drill bit 114 may also include a carrier 528 for hydraulic control system 300. Carrier 528 may be disposed in the bore 520 and extend longitudinally in the bore 520. Carrier 528 may include a proximal carrier end 530 and a distal carrier end 532. At proximal carrier end 530, the carrier 528 may include a cap 534. An additional locking cap 533 may be secured to the proximal carrier end 530 over the cap 534, for example, to hold and position the carrier in the drill bit 114, for example, at proximal end 522 of the drill bit 114. As illustrated, a balancing piston 536 may be positioned in the carrier 528, for example, at distal carrier end 532. Even further, the balancing piston 536 may be positioned in reservoir sleeve 314 that is disposed in carrier 528. Balancing piston 536 may be acted on by external differential pressure, shown as arrow 538. As the external differential pressure 538 increases outside the carrier 528, the balancing piston 536 functions to equalize pressure inside the carrier 528 by application of this pressure to the inside of the carrier 528, thus pressuring fluid in the carrier 528. With the carrier 528 positioned in the bore 520, flow channels 540 may be formed outside the carrier 528 for the flow of drilling fluid through the drill bit 114. This drilling fluid may be exposed to pump pressure from the surface (e.g., standpipe pressure). As the pressure of this drilling fluid increases, the differential pressure 538 on the balancing piston 536 increases and, likewise, as the pressure of this drilling fluid decreases, the differential pressure 538 on the balancing piston 536 also decreases.

The drill bit 114 may also include the hydraulic control system 300. Some of the components of the hydraulic control system 300 may be positioned at least partially in the carrier 528. The hydraulic control system 300 may act to transfer pressurize fluid from within the carrier 528 into one or more of the communication channels (e.g., first communication channel 516, second communication channel 518) and/or release pressurized fluid from the corresponding communication channels. As illustrated, the hydraulic control system 300 may include diagonal ported piston valve 1000 that can be positioned in the carrier 528. A series of spaced seals 316 (e.g., O-rings) may seal be disposed between an exterior of ported piston valve 304 and carrier 528. The diagonal ported piston valve is referred to as "diagonal" because the seals 316 are not positioned with their axis perpendicular with respect to the diagonal ported piston valve 1000. Rather, the seals 316 have an axis that is angled (e.g., not perpendicular or parallel) with respect to the diagonal ported piston valve 1000. The hydraulic control system 300 may further include motor 318 (e.g., electric motor). The motor 318 may be coupled to the diagonal ported piston valve 1000, for example, to rotate the diagonal ported piston valve 1000 in reservoir sleeve 314. While not shown, the carrier 528 may also include a series of ports that can provide for communication between the carrier 528 and the first and second communication channels 516, 518. For example, the diagonal ported piston valve 1000 may be rotated in the carrier 528 to align exit ports 310 with one or more selected ports to provide for selective communication from the carrier 528 to the first and/or second communication channels 516, 518, for example.

The hydraulic control system 300 may further include a control system 548 and sensors 549. Sensors 549 may sense one or more operational parameters or characteristics of the respective equipment (e.g., drill bit 114, motor 318) and communicate one or more measurements of information associated with the operational parameters or characteristics of the respective equipment, or both to motor a control system 548. For example, the sensors 549 may sense one or more of torque, weight on bit, and strain. In some embodiments, the sensors 549 may include one or more of vibration sensors, accelerometers, magnetometers, gyroscopes, and/or pressure transducers. The sensors 549 may collect data, for example, during a drilling operation, and may transmit the collect data in real-time. Any of the one or more sensors 549 may communicatively couple to control system 548 via a wired or wireless connection or directly or indirectly. The control system 548 may control one or more operational parameters or characteristics of the motor 318. For example, the control system 548 may control one or more operational parameters or characteristics of the motor 318 (for example, speed, torque, voltage, current, temperature, acceleration, deceleration, or any other parameters or characteristics). The control system 548 may comprise hardware, software or any combination thereof to process, analyze, store or any combination thereof any information received from any one or more sources, for example, any one or more of sensors 549, devices, components or equipment.

Control system 548 may comprise an information handling system with at least a processor and a memory device coupled to the processor that contains a set of instructions that when executed cause the processor to perform certain actions. In any embodiment, the information handling system may include a non-transitory computer readable medium that stores one or more instructions where the one or more instructions when executed cause the processor to perform certain actions. As used herein, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a computer terminal, a network storage device, or any other suitable device and may vary in size, shape, performance, functionality, and price. The information handling system may include random access memory (RAM), one or more processing resources such as a central processing unit (CPU) or hardware or software control logic, read only memory (ROM), and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components.

Hydraulic control system 300 may include battery 550. As illustrated, battery 550 may be disposed in carrier 528. Battery 550 may provide power to one or more components of the hydraulic control system 300, such as motor 318, control system 548, and/or sensors 549, for example.

Figure 11:
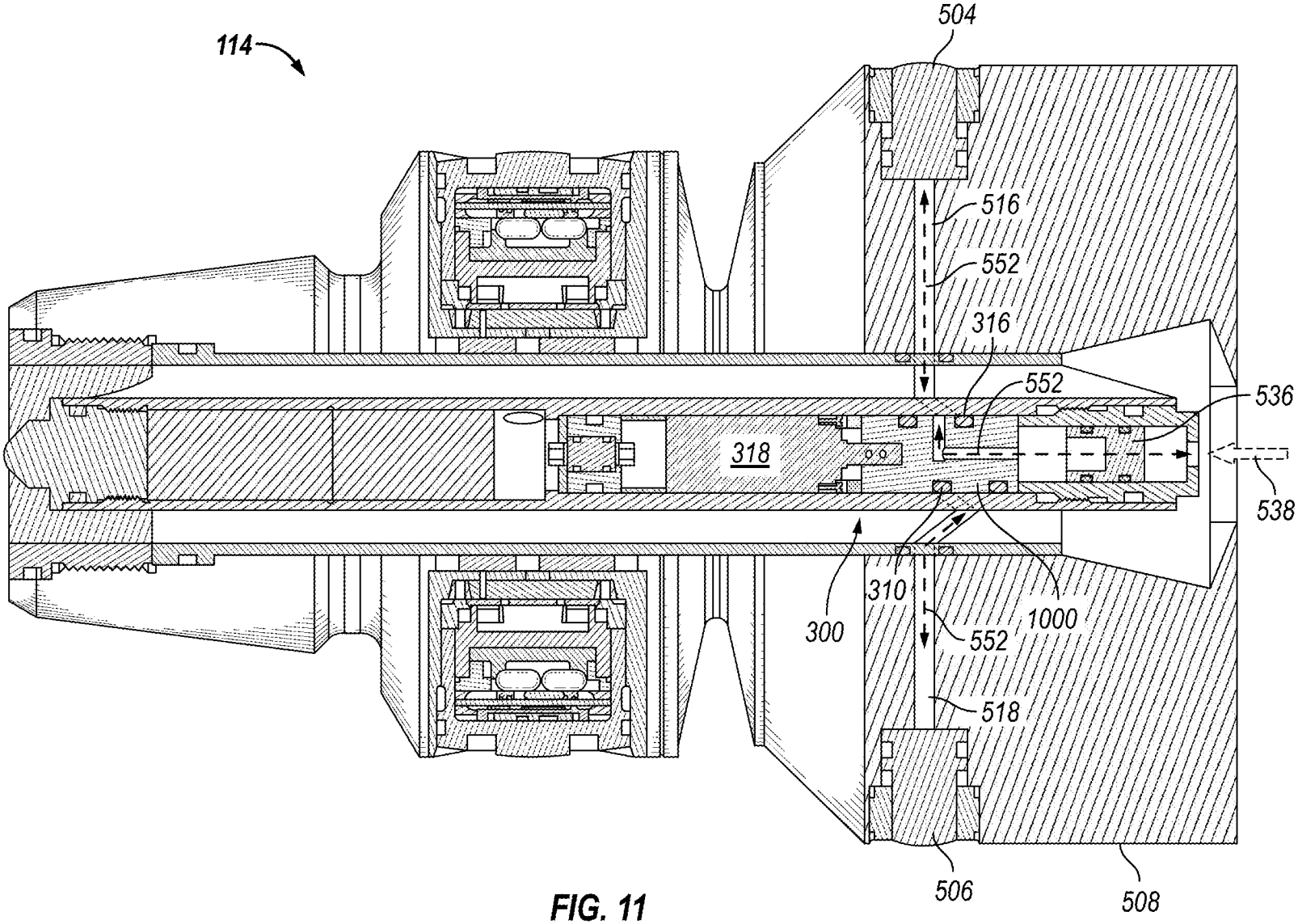
Figure 12:
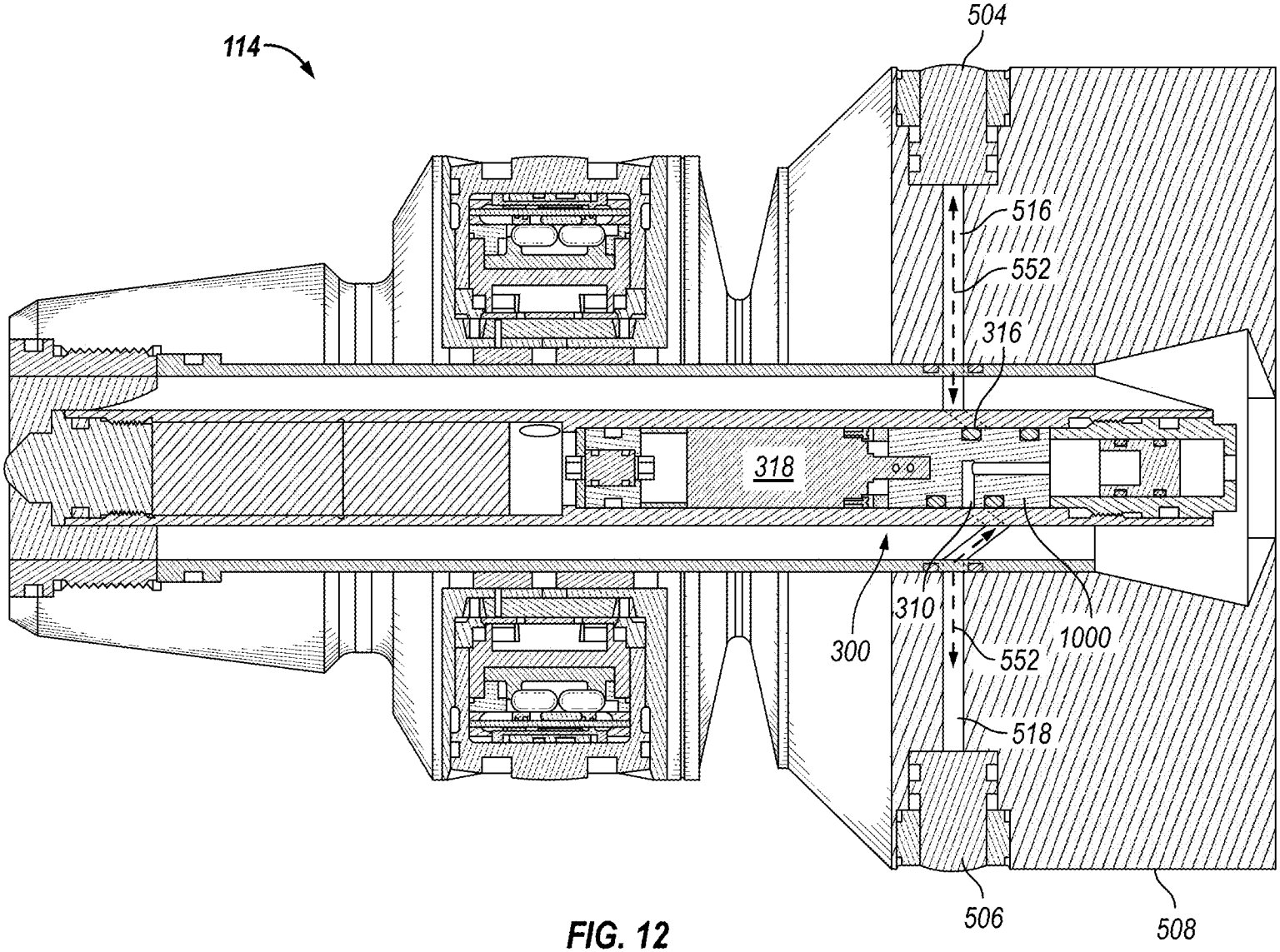

Operation of hydraulic control system 300 of drill bit 114 will now be described with respect to FIGS. 10-12. Turning to FIG. 10, the drill bit 114 is shown with no active lock of the moveable elements, such as the first gauge element 504 and the second gauge element 506. As illustrated, the diagonal ported piston valve 1000 of the hydraulic control system 300 is positioned such that pressurized fluid 552 is not in communication with the communication channels in the drill bit 114, e.g., first communication channel 516 and second communication channel 518. For example, the exit ports 310 are not aligned with any of the communication channels. When desired, for example, in response to measured parameters, hydraulic control system 300 may be activated to rotate the diagonal ported piston valve 1000. As shown on FIG. 11, the hydraulic control system 300 may rotate the diagonal ported piston valve 1000 to a second position with exit ports 310 (only one of which is shown on FIG. 11) aligned with at least one of the communications channels, e.g., first communication channel 516 and second communication channel 518. The motor 318 may rotate the diagonal ported piston valve 1000 to align the exit ports 310 with the first and second communication channels 516, 518. With fluid communication, the fluid in the first and second communication channels 516, 518 may be pressurized such that the fluid is a pressurized fluid 552. As previously described, a differential pressure 538 across the balancing piston 536 may act to increase the pressure. Because the pressurized fluid 552 is in the first and second communication channels 516, 518, the pressure may activate the first and second gauge elements 504, 506. For example, the pressure may act on the first and second gauge elements 504, 506 to provide a biasing pressure, essentially locking them in position. In addition, the pressurized fluid 552 may be locked in the first and second communication channels 516, 518 with the exit ports 310 no longer aligned with the first and second communication channels 516, 518. As shown on FIG. 12, the motor 318 of the hydraulic control system 300 may move the diagonal ported piston valve 1000 to another position where the exit ports 310 are not aligned with the first and second communication channels 516, 518, thus locking the pressurized fluid 552 in the communication channels.

Figure 13:
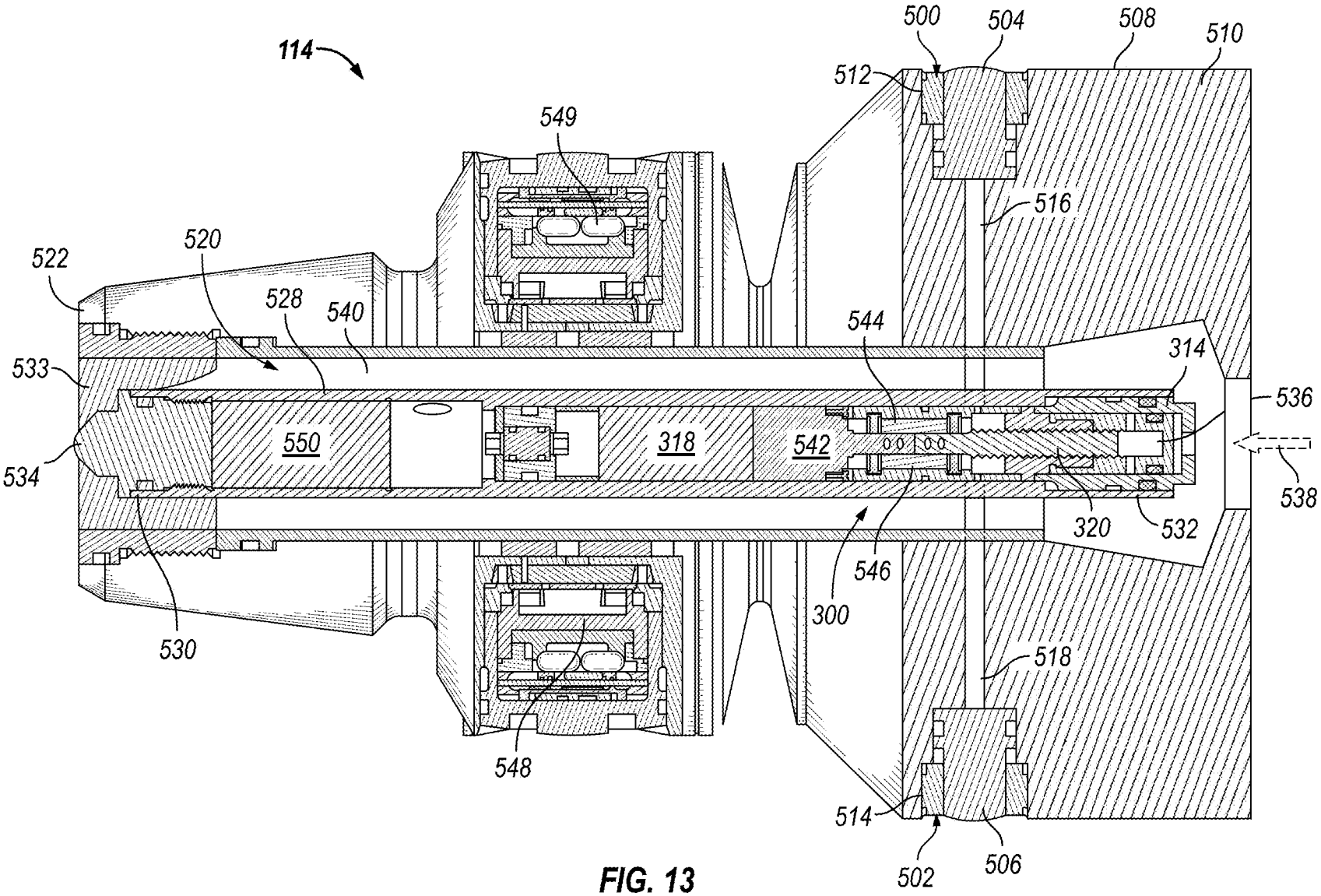
FIGS. 13 and 14 illustrate a cross-sectional view of a drill bit having a hydraulic control system with a syringe element, in accordance with some embodiments of the present disclosure.

FIG. 13 illustrates a cross-sectional view of a drill bit 114 in accordance with some embodiments of the present disclosure. The drill bit 114 is similar to the embodiments shown on FIGS. 5-9, except that the hydraulic control system 300 of FIG. 13 does not include a ported piston valve 304 of FIGS. 5-9. Rather, the drive screw 320 may be coupled to the balancing piston 536. In operation, the drive screw 320 may move the balancing piston inward to pressurize fluid in the drill bit 114, thus driving moveable elements on the drill bit, such as the first and second moveable elements 500, 502. The first moveable element 500 may comprise a first gauge element 504, and the second moveable element 502 may comprise a second gauge element 506. Further, while only two moveable elements 500, 502 are shown, it should be understood that the drill bit 114 may include more or less than two moveable elements. The first and second gauge elements 504, 506 may be configured to protrude from an external surface 508 of the blade 510. Further, the first and second gauge elements 504, 506 may be disposed in and coupled to respective first and second pockets 512, 514. Further, in one or more embodiments, the first and second gauge elements 504, 506 may be configured to extend or retract between a first position in which the first and second gauge elements 504, 506 protrudes from the external surface 508 of the blade 510 by a first distance and a second position in which the first and second gauge elements 504, 506 protrudes from the external surface 508 of the blade 510 by a second distance, which is less than the first distance.

As illustrated, communications channels, such as first and second communication channels 516, 518 may be formed within drill bit 114. As illustrated, the first communication channel 516 may extend between first pocket 512 and bore 520 that extends into drill bit 114 from a proximal end 522. Further, the second communication channel 518 may extend between the second pocket 514 and the bore 520. While not shown, the first and second communication channels 516, 518 may each extend to the carrier 528 to provide a fluid path from with the carrier 528 to the first and second pockets 512, 514, respectively. The first and second communication channels 516, 518 may be filled with a fluid, such as a hydraulic fluid. Further, in one or more embodiments, the first moveable element 500 may form a seal within the first pocket 512 such that the fluid in the first communication channel 516 and the first moveable element 500 may form a piston. Thus, in or more embodiments, pressurized fluid from the bore 520 may act on the first gauge element 504 to bias the first gauge element 504 outward. Similarly, pressure from the bore 520 may be released to cause the first gauge element 504 to retract further into the first pocket 512. Further, in one or more embodiments, the second gauge element 506 may form a seal within the second pocket 514, such that the fluid in the second communication channel 518 and the second gauge element 506 may form a piston. Thus, in or more embodiments, pressurized fluid from the bore 520 may act on the second gauge element 506 to bias the second gauge element 506 outward. Similarly, pressure from the bore 520 may be released to cause the second moveable element 502 to retract further into the second pocket 514. While not shown, one or more additional communication channels may be formed within the drill bit 114 for coupling additional moveable elements on the drill bit 114 to pressurized fluid in the carrier 528. While the preceding describes spring bias, example embodiments may include no spring bias.

The drill bit 114 may also include a carrier 528 for hydraulic control system 300. Carrier 528 may be disposed in the bore 520 and extend longitudinally in the bore 520. Carrier 528 may include a proximal carrier end 530 and a distal carrier end 532. At proximal carrier end 530, the carrier 528 may include a cap 534. An additional locking cap 533 may be secured to the proximal carrier end 530 over the cap 534, for example, to hold and position the carrier in the drill bit 114, for example, at proximal end 522 of the drill bit 114. As illustrated, a balancing piston 536 may be positioned in the carrier 528, for example, at distal carrier end 532. Even further, the balancing piston 536 may be positioned in reservoir sleeve 314 that is disposed in carrier 528. Balancing piston 536 may be acted on by external differential pressure, shown as arrow 538. As the external differential pressure 538 increases outside the carrier 528, the balancing piston 536 functions to equalize pressure inside the carrier 528 by application of this pressure to the inside of the carrier 528, thus pressuring fluid in the carrier 528. With the carrier 528 positioned in the bore 520, flow channels 540 may be formed outside the carrier 528 for the flow of drilling fluid through the drill bit 114. This drilling fluid may be exposed to pump pressure from the surface (e.g., standpipe pressure). As the pressure of this drilling fluid increases, the differential pressure 538 on the balancing piston 536 increases and, likewise, as the pressure of this drilling fluid decreases, the pressure on differential pressure 538 on the balancing piston 536 also decreases.

The drill bit 114 may also include the hydraulic control system 300. Some of the components of the hydraulic control system 300 may be positioned at least partially in the carrier 528. The hydraulic control system 300 may act to transfer pressurize fluid from within the carrier 528 into one or more of the communication channels (e.g., first communication channel 516, second communication channel 518) and/or release pressurized fluid from the corresponding communication channels. As illustrated, the hydraulic control system 300 may further include motor 318 (e.g., electric motor). The motor 318 may be coupled to the balancing piston 536, for example, to linearly drive the balancing piston 536 in reservoir sleeve 314. As illustrated, hydraulic control system 300 may include drive screw 320 that couples motor 318 to the balancing piston 536. Drive screw 320 may convert rotary motion of motor 318 to linear motion for linearly driving the balancing piston 536. As illustrated, the motor 318 may be coupled to a gear reducer 542 for control of output speed. Motor 318 may also include one or more bearings, such as thrust bearing 544 and split bearing 546. While not shown, the carrier 528 may also include a series of ports that may provide for fluid communication between an interior of the carrier 528 and the first and second communication channels 516, 518, for example.

The hydraulic control system 300 may further include a control system 548 and sensors 549. Sensors 549 may sense one or more operational parameters or characteristics of the respective equipment (e.g., drill bit 114, motor 318) and communicate one or more measurements or information associated with the operational parameters or characteristics of the respective equipment, or both to motor a control system 548. For example, the sensors 549 may sense one or more of torque, weight on bit, and strain. In some embodiments, the sensors 549 may include one or more of vibration sensors, accelerometers, magnetometers, gyroscopes, and/or pressure transducers. The sensors 549 may collect data, for example, during a drilling operation, and may transmit the collected data in real-time. Any of the one or more sensors 549 may communicatively couple to control system 548 via a wired or wireless connection or directly or indirectly. The control system 548 may control one or more operational parameters or characteristics of the motor 318. For example, the control system 548 may control one or more operational parameters or characteristics of the motor 318 (for example, speed, torque, voltage, current, temperature, acceleration, deceleration, or any other parameters or characteristics). The control system 548 may comprise hardware, software or any combination thereof to process, analyze, store or any combination thereof any information received from any one or more sources, for example, any one or more of sensors 549, devices, components or equipment.

Control system 548 may comprise an information handling system with at least a processor and a memory device coupled to the processor that contains a set of instructions that when executed cause the processor to perform certain actions. In any embodiment, the information handling system may include a non-transitory computer readable medium that stores one or more instructions where the one or more instructions when executed cause the processor to perform certain actions. As used herein, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a computer terminal, a network storage device, or any other suitable device and may vary in size, shape, performance, functionality, and price. The information handling system may include random access memory (RAM), one or more processing resources such as a central processing unit (CPU) or hardware or software control logic, read only memory (ROM), and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components.

Hydraulic control system 300 may include battery 550. As illustrated, battery 550 may be disposed in carrier 528. Battery 550 may provide power to one or more components of the hydraulic control system 300, such as motor 318, control system 548, and/or sensors 549, for example.

Figure 14:
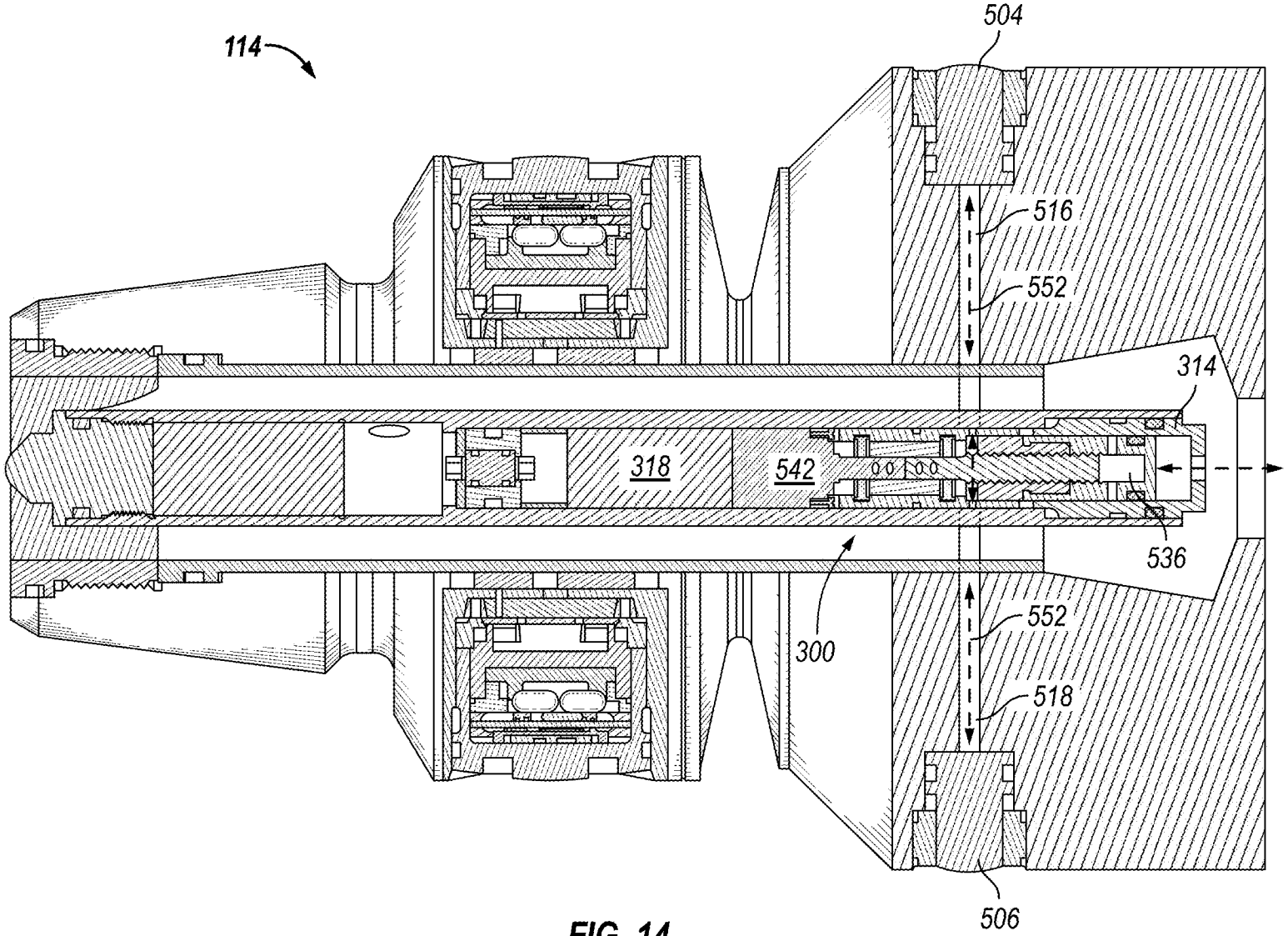

Operation of hydraulic control system 300 of drill bit 114 will now be described with respect to FIGS. 13 and 14. Turning to FIG. 13, the drill bit 114 is shown with no active lock of the moveable elements, such as the first gauge element 504 and second gauge element 506. When desired, for example, in response to measured parameters, hydraulic control system 300 may be activated to move balancing piston 536. As shown on FIG. 14, the hydraulic control system 300 may move the balancing piston 536. For example, the motor 318 may linearly move the balancing piston 536 in the reservoir sleeve 314, thus pressuring fluid in the reservoir sleeve 314 and drawing pressuring fluid 552 into the first and second communication channels 516, 518. With fluid communication, the fluid in the first and second communication channels 516, 518 may be pressurized such that the fluid is a pressurized fluid 552. Because the pressurized fluid 552 is in the first and second communication channels 516, 518, the pressure may activate the first and second gauge elements 504, 506. For example, the pressure may act on the first and second gauge elements 504, 506 to provide a biasing pressure, essentially locking them in position. When desired to unlock the first and second gauge elements 504, 506, the balancing piston 536 may be moved back to its original position (FIG. 13), thus releasing the pressure in the first and second communication channels 516, 518.

Figure 15:
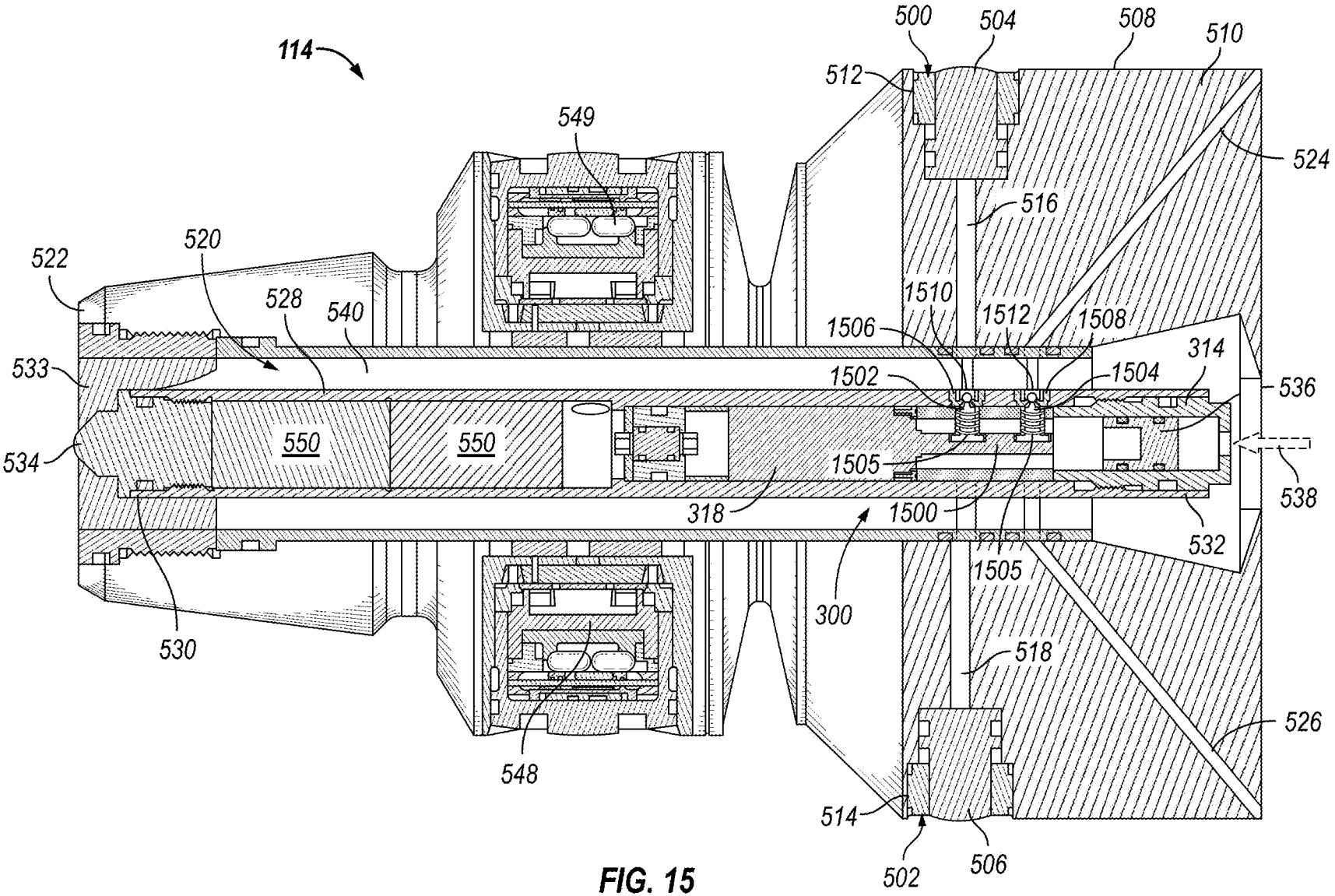
FIGS. 15-18 illustrate a cross-sectional view of a drill bit having a hydraulic control system with a manifold that uses a lobbed camshaft for valve actuation, in accordance with some embodiments of the present disclosure.

FIG. 15 illustrates a cross-sectional view of a drill bit 114 in accordance with some embodiments of the present disclosure. The drill bit 114 is similar to FIG. 5 but uses a lobbed cam piston activation method in place of the ported piston valve 304 (e.g., FIG. 5). For example, the hydraulic control system may include a lobbed camshaft 1500 that interacts with first and second ball pistons 1502, 1504 to selectively activate two moveable elements, shown as first moveable element 500 and second moveable element 502. The first moveable element 500 may comprise a first gauge element 504, and the second moveable element 502 may comprise a second gauge element 506. Further, while only two moveable elements 500, 502 are shown, it should be understood that the drill bit 114 may include more or less than two moveable elements. The first and second gauge elements 504, 506 may be configured to protrude from an external surface 508 of the blade 510. Further, the first and second gauge elements 504, 506 may be disposed in and coupled to respective first and second pockets 512, 514. Further, in one or more embodiments, the first and second gauge elements 504, 506 may be configured to extend or retract between a first position in which the first and second gauge elements 504, 506 protrudes from the external surface 508 of the blade 510 by a first distance and a second position in which the first and second gauge elements 504, 506 protrudes from the external surface 508 of the blade 510 by a second distance, which is less than the first distance.

As illustrated, communications channels, such as first and second communication channels 516, 518 may be formed within drill bit 114. As illustrated, the first communication channel 516 may extend between first pocket 512 and bore 520 that extends into drill bit 114 from a proximal end 522. Further, the second communication channel 518 may extend between the second pocket 514 and the bore 520. While not shown, the first and second communication channels 516, 518 may each extend to the carrier 528 to provide a fluid path from with the carrier 528 to the first and second pockets 512, 514, respectively. The first and second communication channels 516, 518 may be filled with a fluid, such as a hydraulic fluid. Further, in one or more embodiments, the first moveable element 500 may form a seal within the first pocket 512 such that the fluid in the first communication channel 516 and the first moveable element 500 may form a piston. Thus, in or more embodiments, pressurized fluid from the bore 520 may act on the first gauge element 504 to bias the first gauge element 504 outward. Similarly, pressure from the bore 520 may be released to cause the first gauge element 504 to retract further into the first pocket 512. Further, in one or more embodiments, the second gauge element 506 may form a seal within the second pocket 514, such that the fluid in the second communication channel 518 and the second gauge element 506 may form a piston. Thus, in or more embodiments, pressurized fluid from the bore 520 may act on the second gauge element 506 to bias the second gauge element 506 outward. Similarly, pressure from the bore 520 may be released to cause the second moveable element 502 to retract further into the second pocket 514. While not shown, one or more additional communication channels may be formed within the drill bit 114 for coupling additional moveable elements on the drill bit 114 to pressurized fluid in the carrier 528. While the preceding describes spring bias, example embodiments may include no spring bias.

Additional communication channels may be formed within the drill bit 114. As illustrated, third communication channel 524 and fourth communication channel 526 may also be formed with the drill bit 114 that each extend from the bore 520. While not shown, the third and fourth communication channels 524, 526 may each extend to additional moveable elements, such as DOCC elements, gauge elements, and moveable arms) on the drill bit 114.

The drill bit 114 may also include a carrier 528 for hydraulic control system 300. Carrier 528 may be disposed in the bore 520 and extend longitudinally in the bore 520. Carrier 528 may include a proximal carrier end 530 and a distal carrier end 532. At proximal carrier end 530, the carrier 528 may include a cap 534. An additional locking cap 533 may be secured to the proximal carrier end 530 over the cap 534, for example, to hold and position the carrier in the drill bit 114, for example, at proximal end 522 of the drill bit 114. As illustrated, a balancing piston 536 may be positioned in the carrier 528, for example, at distal carrier end 532. Even further, the balancing piston 536 may be positioned in reservoir sleeve 314 that is disposed in carrier 528. Balancing piston 536 may be acted on by external differential pressure, shown as arrow 538. As the external differential pressure 538 increases outside the carrier 528, the balancing piston 536 functions to equalize pressure inside the carrier 528 by application of this pressure to the inside of the carrier 528, thus pressuring fluid in the carrier 528. With the carrier 528 positioned in the bore 520, flow channels 540 may be formed outside the carrier 528 for the flow of drilling fluid through the drill bit 114. This drilling fluid may be exposed to pump pressure from the surface (e.g., standpipe pressure). As the pressure of this drilling fluid increases, the differential pressure 538 on the balancing piston 536 increases and, likewise, as the pressure of this drilling fluid decreases, the pressure on differential pressure 538 on the balancing piston 536 also decreases.

The drill bit 114 may also include the hydraulic control system 300. Some of the components of the hydraulic control system 300 may be positioned at least partially in the carrier 528. The hydraulic control system 300 may act to transfer pressurize fluid from within the carrier 528 into one or more of the communication channels (e.g., first communication channel 516, second communication channel 518, third communication channel 524, and fourth communication channel 526) and/or release pressurized fluid from the corresponding communication channels. As illustrated, the hydraulic control system 300 may include lobbed camshaft 1500. The lobbed camshaft may be positioned in the carrier 528. For example, the lobbed camshaft 1500 may extend longitudinally in reservoir sleeve 314 that is positioned in the carrier 528. The hydraulic control system 300 may further include first and second ball pistons 1502, 1504. As illustrated, the first and second ball pistons 1502, 1504 may extend from the lobbed camshaft 1500 through the reservoir sleeve 314 to respective first and second piston seats 1506, 1508 formed in the carrier 528. The first and second piston seats 1506, 1508 may be formed in first and second ports 1510, 1512 that extend through the carrier 528. When seated in the first and second piston seats 1506, 1508, the first and second ball pistons 1502, 1504 block the first and second ports 1510, 1512 in the carrier 528. The first and second ball pistons 1502, 1504 may be spring-loaded, for example with springs 1505. The lobbed camshaft 1500 may include a series of lobes along its shaft in various positioned that are configured to interact with at least the first and second ball pistons 1502, 1504 to selectively open and close the first and second ports 1510, 1512 as the lobbed camshaft 1500 rotates. The first and second ports 1510, 1512 may be in communication, for example, with the first communication channel 516 and third communication channel 524, respectively.

The hydraulic control system 300 may further include motor 318 (e.g., electric motor). The motor 318 may be coupled to the lobbed camshaft 1500, for example, to rotate the lobbed camshaft in the reservoir sleeve 314. For example, the sensors 549 may sense one or more of torque, weight on bit, and strain. In some embodiments, the sensors 549 may include one or more of vibration sensors, accelerometers, magnetometers, gyroscopes, and/or pressure transducers. Sensors 549 may sense one or more operational parameters or characteristics of the respective equipment (e.g., drill bit 114, motor 318) and communicate one or more measurements or information associated with the operational parameters or characteristics of the respective equipment, or both to motor a control system 548. For example, the sensors 549 may sense one or more of torque, weight on bit, and strain. In some embodiments, the sensors 549 may include one or more of vibration sensors, accelerometers, magnetometers, gyroscopes, and/or pressure transducers. The sensors 549 may collect data, for example, during a drilling operation, and may transmit the collected data in real-time. Any of the one or more sensors 549 may communicatively couple to control system 548 via a wired or wireless connection or directly or indirectly. The control system 548 may control one or more operational parameters or characteristics of the motor 318. For example, the control system 548 may control one or more operational parameters or characteristics of the motor 318 (for example, speed, torque, voltage, current, temperature, acceleration, deceleration, or any other parameters or characteristics). The control system 548 may comprise hardware, software or any combination thereof to process, analyze, store or any combination thereof any information received from any one or more sources, for example, any one or more of sensors 549, devices, components or equipment.

Control system 548 may comprise an information handling system with at least a processor and a memory device coupled to the processor that contains a set of instructions that when executed cause the processor to perform certain actions. In any embodiment, the information handling system may include a non-transitory computer readable medium that stores one or more instructions where the one or more instructions when executed cause the processor to perform certain actions. As used herein, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a computer terminal, a network storage device, or any other suitable device and may vary in size, shape, performance, functionality, and price. The information handling system may include random access memory (RAM), one or more processing resources such as a central processing unit (CPU) or hardware or software control logic, read only memory (ROM), and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components.

Figure 16:
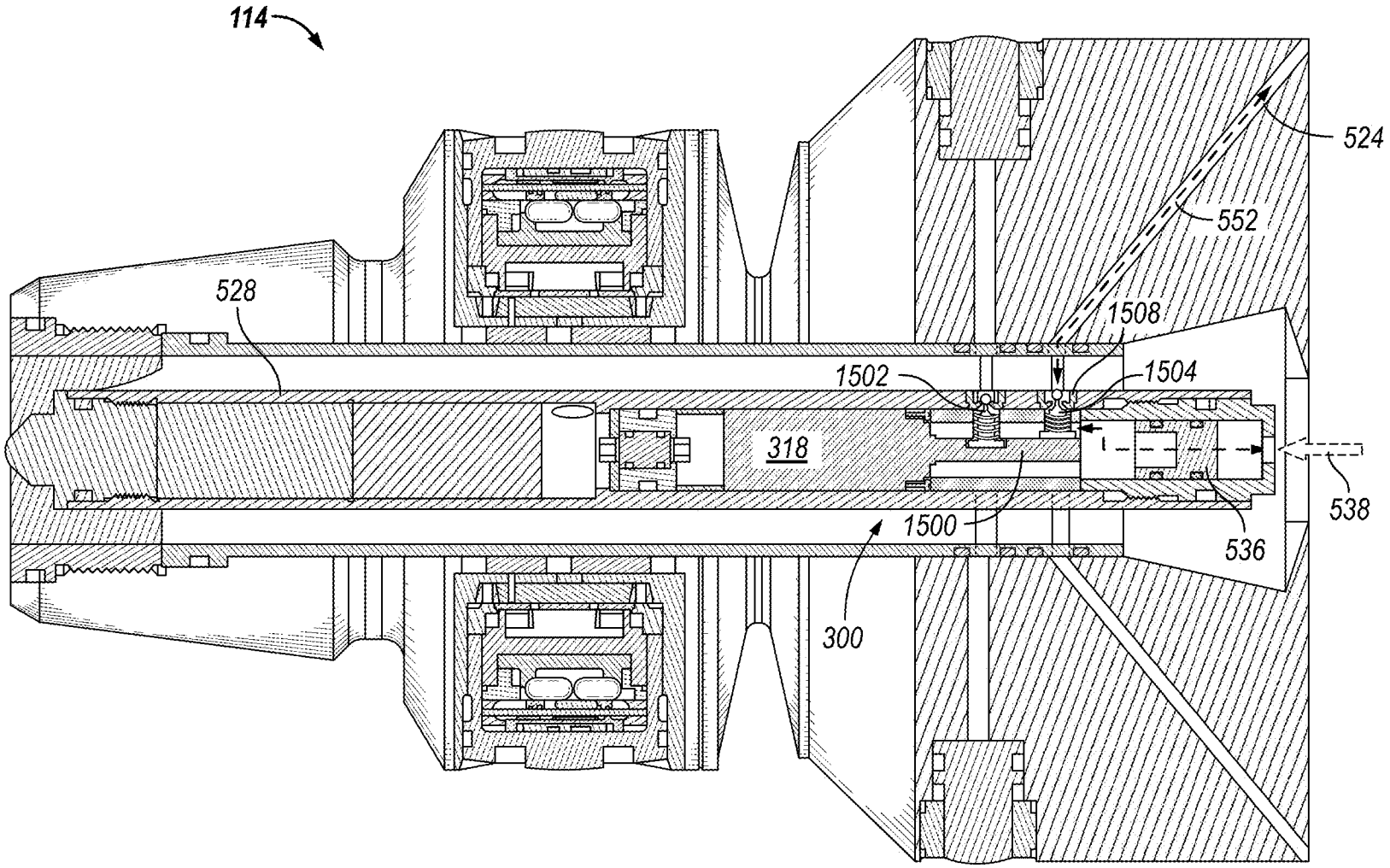

Hydraulic control system 300 may include battery 550. As illustrated, battery 550 may be disposed in carrier 528. Battery 550 may provide power to one or more components of the hydraulic control system 300, such as motor 318, control system 548, and/or sensors 549, for example, Operation of hydraulic control system 300 of drill bit 114 will now be described with respect to FIGS. 15-18. Turning to FIG. 15, the drill bit 114 is shown with no active lock of the moveable elements, such as the first gauge element 504 and second gauge element 506. As illustrated, the first and second ball pistons 1502, 1504 are seated in the first and second piston seats 1506, 1508 blocking flow into the first communication channel 516 and third communication channel 524, respectively. When desired, for example, in response to measured parameters, hydraulic control system 300 may be activated to move lobbed camshaft 1500. For example, the lobbed camshaft 1500 may be rotated to cause one of the first and second ball pistons 1502, 1504 to unseat. The motor 318 may cause the rotation of the lobbed camshaft 1500. As illustrated on FIG. 16, the second ball piston 1504 may be moved by the lobbed camshaft 1500, thus unseating from the second piston seat 1508. With the second ball piston 1504 unseated, there is now communication from inside the carrier 528 to the third communication channel 524, allowing pressurization in the third communication channel 524 so that pressurized fluid 552 flows into the third communication channel 524. While not shown, an additional moveable elements may be associated with the third communication channel 524 such that the pressurized fluid 552 can provide biasing pressure to the additional moveable elements, for example, locking the additional moveable element in position and/or moving it outward from the drill bit 114. As previously described, a differential pressure 538 across the balancing piston 536 may act to increase the pressure. Because the pressurized fluid 552 is in the third communication channel 524, the pressure may activate the corresponding moveable element.

Figure 17:
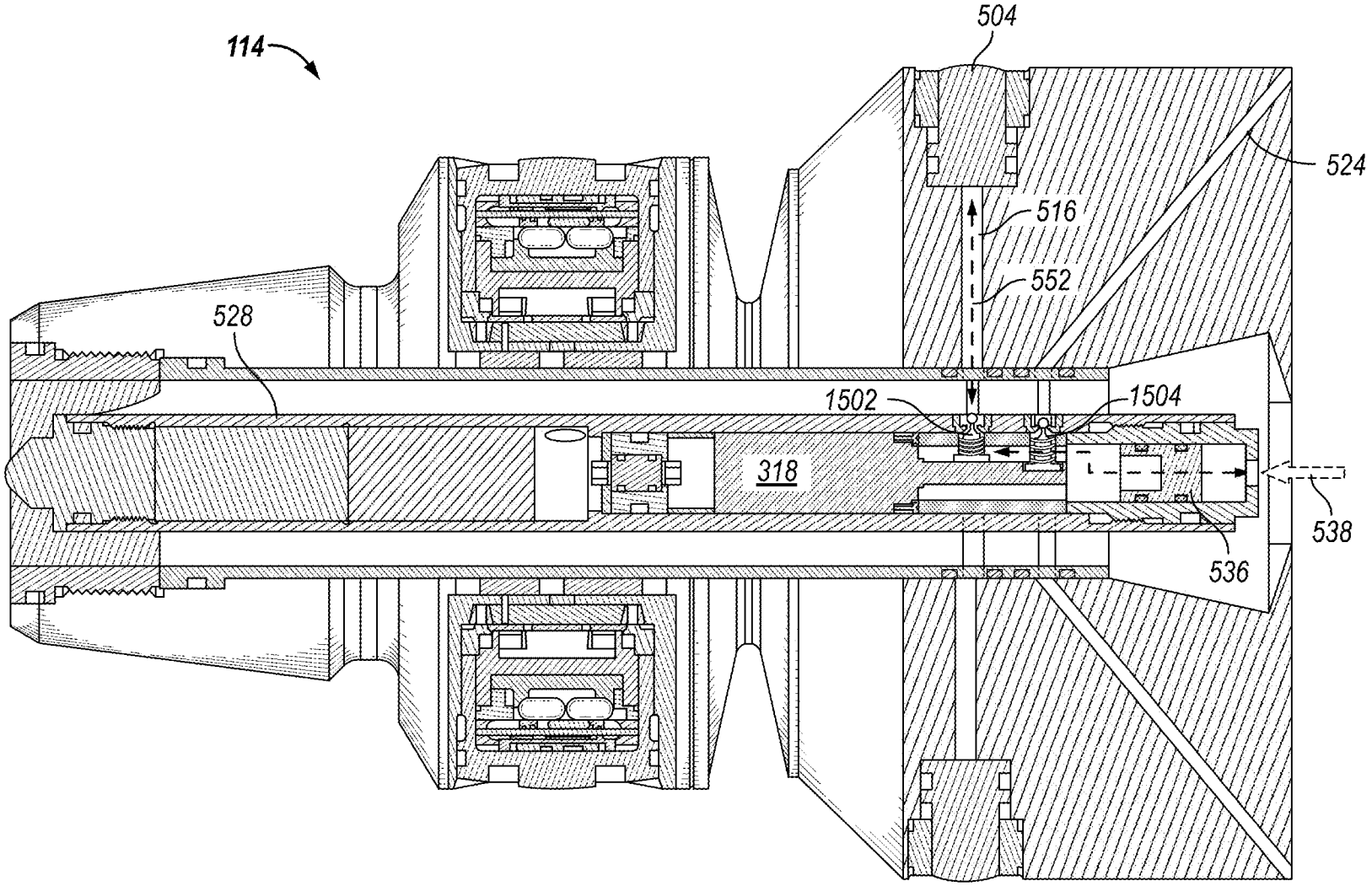
Figure 18:
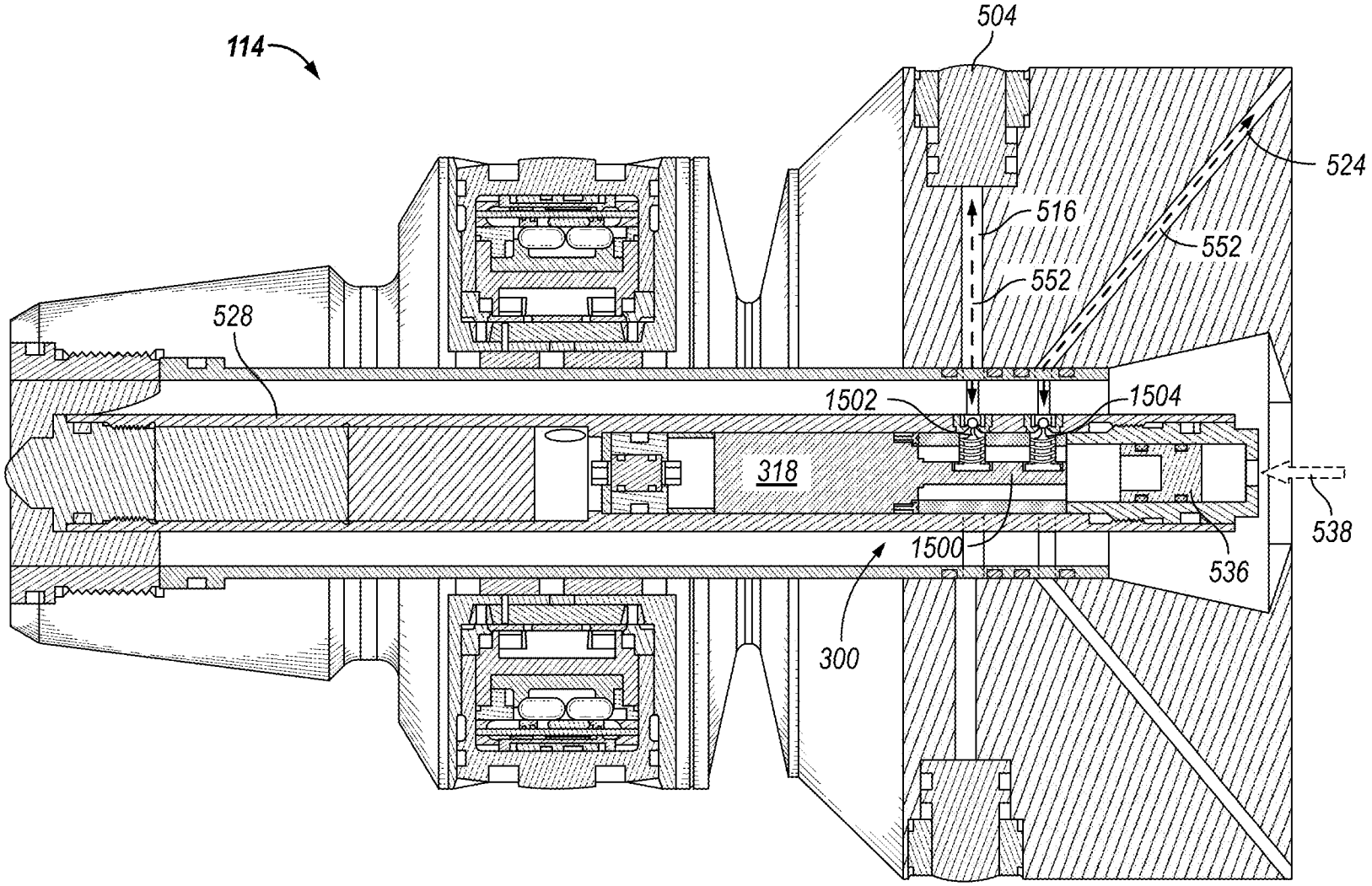

The hydraulic control system 300 may be used to selectively lock moveable elements. As shown on FIG. 16, the moveable element (not shown) associated with the third communication channel 324 may be locked. With reference now to FIG. 17, an additional moveable element (e.g., first gauge element 504) may be locked when desired, for example, in response to measured parameters. For example, the lobbed camshaft 1500 may be rotated to cause the first ball piston 1502. The motor 318 may cause rotation of the lobbed camshaft 1500. As illustrated, the first ball piston 1502 may be moved by the lobbed camshaft 1500, thus unseating from the first piston seat 1506. The second ball piston 1504 may remain seated. With the first ball piston 1502 unseated, there is now communication from inside the carrier 528 to the first communication channel 524. As previously described, a differential pressure 538 across the balancing piston 536 may act to increase the pressure. Because the pressurized fluid 552 is in the first communication channel 524, this pressure increase may activate the first gauge element 504 associated with the first communication channel 524. For example, the first gauge element 504 may be locked in place and/or moved outward. With the pressurized fluid 552 in the first communication channel 516, as shown on FIG. 18, an additional moveable element (not shown) associated with the third communication channel 524 may also be locked when desired, for example, in response to measured parameters. The hydraulic control system 300 may be activated to move lobbed camshaft 1500. For example, the lobbed camshaft 1500 may be rotated to cause the second ball piston 1504 to unseat. The motor 318 may cause the rotation of the lobbed camshaft 1500. The lobes on the lobbed camshaft 1500 may arranged such that the second ball piston 1504 is unseated while the first ball piston 1502 is also unseated. With the second ball piston 1504 unseated, there is now communication from inside the carrier 528 to the third communication channel 524, allowing pressurization in the third communication channel 524 so that pressurized fluid 552 flows into the third communication channel 524. As the first ball piston 1502 is also unseated, there is also communication from inside the carrier 528 to the first communication channel 516 with pressurized fluid 552 in the first communication channel 516. As previously described, a differential pressure 538 across the balancing piston 536 may act to increase the pressure in the first communication channel 516 and the third communication channel 524. Because the pressurized fluid 552 is in the first communication channel 516 and the third communication channel 524, the pressure may activate the first gauge element 504 associated with the first communication channel 516 and the additional moveable element (not shown) associated with the third communication channel 524.

Figure 19:
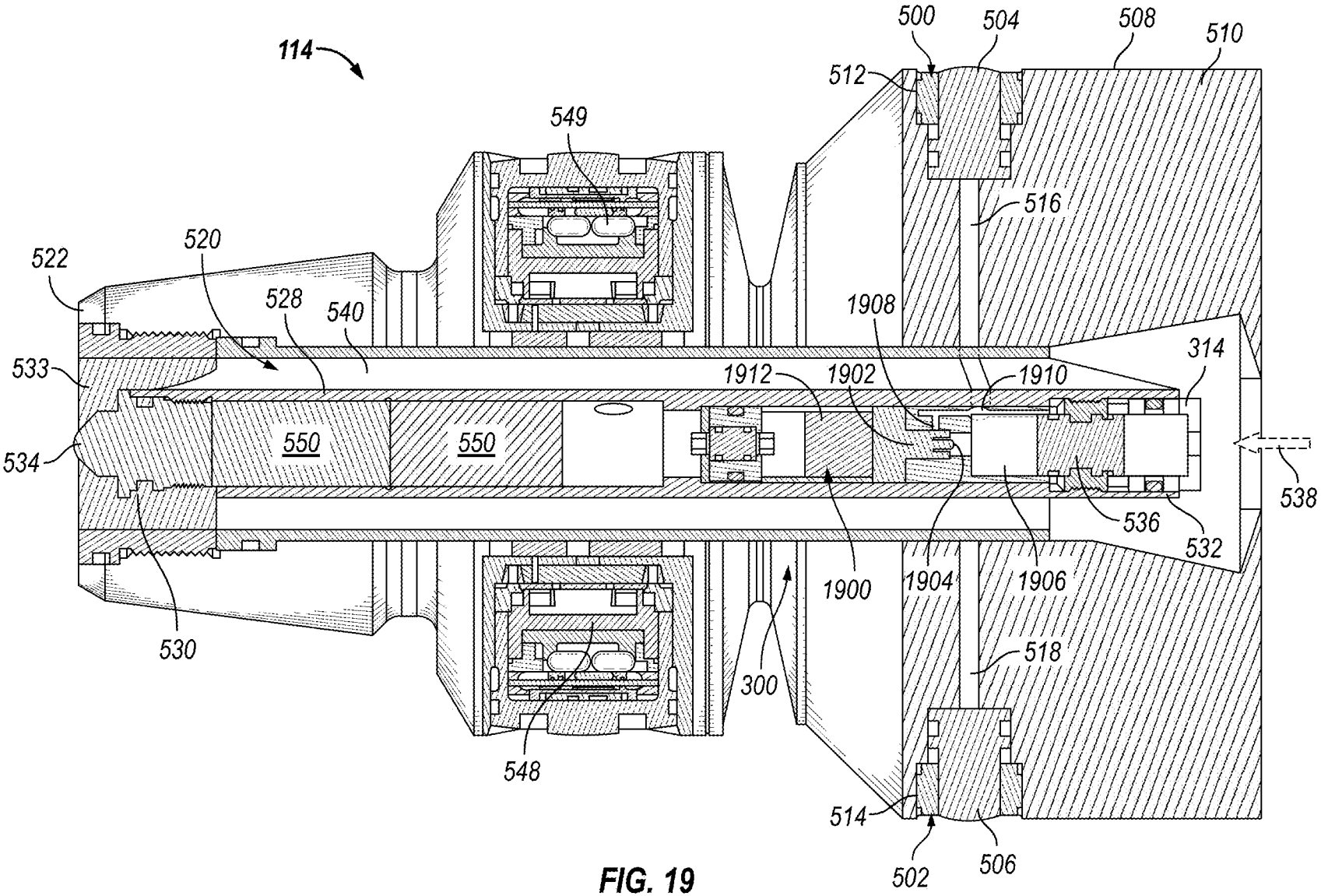
FIGS. 19 and 20 illustrate a cross-sectional view of a drill bit having a hydraulic control system with a solenoid valve, in accordance with some embodiments of the present disclosure.

FIG. 19 illustrates a cross-sectional view of a drill bit 114 in accordance with some embodiments of the present disclosure. The drill bit 114 is similar to FIG. 5 but uses solenoid valve 1900 in place of the ported piston valve 304 (e.g., FIG. 5). For example, the hydraulic control system 300 may include the solenoid valve 1900 that controls the flow of pressurized fluid into the communication channels, such as first and second communication channels, for activation of the two moveable elements, shown as first moveable element 500 and second moveable element 502. The first moveable element 500 may comprise a first gauge element 504, and the second moveable element 502 may comprise a second gauge element 506. Further, while only two moveable elements 500, 502 are shown, it should be understood that the drill bit 114 may include more or less than two moveable elements. The first and second gauge elements 504, 506 may be configured to protrude from an external surface 508 of the blade 510. Further, the first and second gauge elements 504, 506 may be disposed in and coupled to respective first and second pockets 512, 514. Further, in one or more embodiments, the first and second gauge elements 504, 506 may be configured to extend or retract between a first position in which the first and second gauge elements 504, 506 protrudes from the external surface 508 of the blade 510 by a first distance and a second position in which the first and second gauge elements 504, 506 protrudes from the external surface 508 of the blade 510 by a second distance, which is less than the first distance.

As illustrated, communications channels, such as first and second communication channels 516, 518 may be formed within drill bit 114. As illustrated, the first communication channel 516 may extend between first pocket 512 and bore 520 that extends into drill bit 114 from a proximal end 522. Further, the second communication channel 518 may extend between the second pocket 514 and the bore 520. While not shown, the first and second communication channels 516, 518 may each extend to the carrier 528 to provide a fluid path from with the carrier to the first and second pockets 512, 514, respectively. The first and second communication channels 516, 518 may be filled with a fluid, such as a hydraulic fluid. Further, in one or more embodiments, the first moveable element 500 may form a seal within the first pocket 512 such that the fluid in the first communication channel 516 and the first moveable element 500 may form a piston. Thus, in or more embodiments, pressurized fluid from the bore 520 may act on the first gauge element 504 to bias the first gauge element 504 outward. Similarly, pressure from the bore 520 may be released to cause the first gauge element 504 to retract further into the first pocket 512. Further, in one or more embodiments, the second gauge element 506 may form a seal within the second pocket 514, such that the fluid in the second communication channel 518 and the second gauge element 506 may form a piston. Thus, in or more embodiments, pressurized fluid from the bore 520 may act on the second gauge element 506 to bias the second gauge element 506 outward. Similarly, pressure from the bore 520 may be released to cause the second moveable element 502 to retract further into the second pocket 514. While not shown, one or more additional communication channels may be formed within the drill bit 114 for coupling additional moveable elements on the drill bit 114 to pressurized fluid in the carrier 528. While the preceding describes spring bias, example embodiments may include no spring bias.

The drill bit 114 may also include a carrier 528 for hydraulic control system 300. Carrier 528 may be disposed in the bore 520 and extend longitudinally in the bore 520. Carrier 528 may include a proximal carrier end 530 and a distal carrier end 532. At proximal carrier end 530, the carrier 528 may include a cap 534. An additional locking cap 533 may be secured to the proximal carrier end 530 over the cap 534, for example, to hold and position the carrier in the drill bit 114, for example, at proximal end 522 of the drill bit 114. As illustrated, a balancing piston 536 may be positioned in the carrier 528, for example, at distal carrier end 532. Even further, the balancing piston 536 may be positioned in reservoir sleeve 314 that is disposed in carrier 528. Balancing piston 536 may be acted on by external differential pressure, shown as arrow 538. As the external differential pressure 538 increases outside the carrier 528, the balancing piston 536 functions to equalize pressure inside the carrier 528 by application of this pressure to the inside of the carrier 528, thus pressuring fluid in the carrier 528. With the carrier 528 positioned in the bore 520, flow channels 540 may be formed outside the carrier 528 for the flow of drilling fluid through the drill bit 114. This drilling fluid may be exposed to pump pressure from the surface (e.g., standpipe pressure). As the pressure of this drilling fluid increases, the differential pressure 538 on the balancing piston 536 increases and, likewise, as the pressure of this drilling fluid decreases, the pressure on differential pressure 538 on the balancing piston 536 also decreases.

The drill bit 114 may also include the hydraulic control system 300. Some of the components of the hydraulic control system 300 may be positioned at least partially in the carrier 528. The hydraulic control system 300 may act to transfer pressurized fluid from within the carrier 528 into one or more of the communication channels (e.g., first communication channel 516, second communication channel 518) and/or release pressurized fluid from the corresponding communication channels. As illustrated, the hydraulic control system 300 may include solenoid valve 1900 for control of pressurized fluid. Solenoid valve 1900 may include a valve element 1902 that is positioned in carrier 528. Valve element 1902 includes a pressure port 1904 that is in communication with a fluid chamber 1906 between the valve element 1902 and balancing piston 536. The valve element 1902 also includes a control port 1908 that is in communication with first communication channel 516 by way of flow channel 1910 in carrier 528. Additional flow channels formed through carrier 528 and bore 520 for coupling the flow channel 1910 and first communication channel 516 are not shown. When the solenoid valve 1900 is open, the pressure port 1904 and control port 1908 are fluidically coupled to allow fluid and pressure transmission through the solenoid valve 1900. When the solenoid valve 1900 is closed, the pressure port 1904 and control port 1908 are isolated from one another such that fluid and pressure transmission does not occur through the solenoid valve 1900. The solenoid valve 1900 further includes a solenoid 1912. When energized, the solenoid 1912 functions to open and close the valve element 1902.

The hydraulic control system 300 may further include a control system 548 and sensors 549. Sensors 549 may sense one or more operational parameters or characteristics of the respective equipment (e.g., drill bit 114, solenoid valve 1900) and communicate one or more measurements or information associated with the operational parameters or characteristics of the respective equipment, or both to motor a control system 548. For example, the sensors 549 may sense one or more of torque, weight on bit, and strain. In some embodiments, the sensors 549 may include one or more of vibration sensors, accelerometers, magnetometers, gyroscopes, and/or pressure transducers. The sensors 549 may collect data, for example, during a drilling operation, and may transmit the collect data in real-time. Any of the one or more sensors 549 may communicatively couple to control system 548 via a wired or wireless connection or directly or indirectly. The control system 548 may control the solenoid valve 1900. For example, the control system 548 may control the flow of current to the solenoid 1912, thus controlling the opening and closing of the solenoid valve 1900. The control system 548 may comprise hardware, software or any combination thereof to process, analyze, store or any combination thereof any information received from any one or more sources, for example, any one or more of sensors 549, devices, components or equipment.

Control system 548 may comprise an information handling system with at least a processor and a memory device coupled to the processor that contains a set of instructions that when executed cause the processor to perform certain actions. In any embodiment, the information handling system may include a non-transitory computer readable medium that stores one or more instructions where the one or more instructions when executed cause the processor to perform certain actions. As used herein, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a computer terminal, a network storage device, or any other suitable device and may vary in size, shape, performance, functionality, and price. The information handling system may include random access memory (RAM), one or more processing resources such as a central processing unit (CPU) or hardware or software control logic, read only memory (ROM), and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components.

Hydraulic control system 300 may include battery 550. As illustrated, battery 550 may be disposed in carrier 528. Battery 550 may provide power to one or more components of the hydraulic control system 300, such as motor 318, control system 548, and/or sensors 549, for example.

Figure 20:
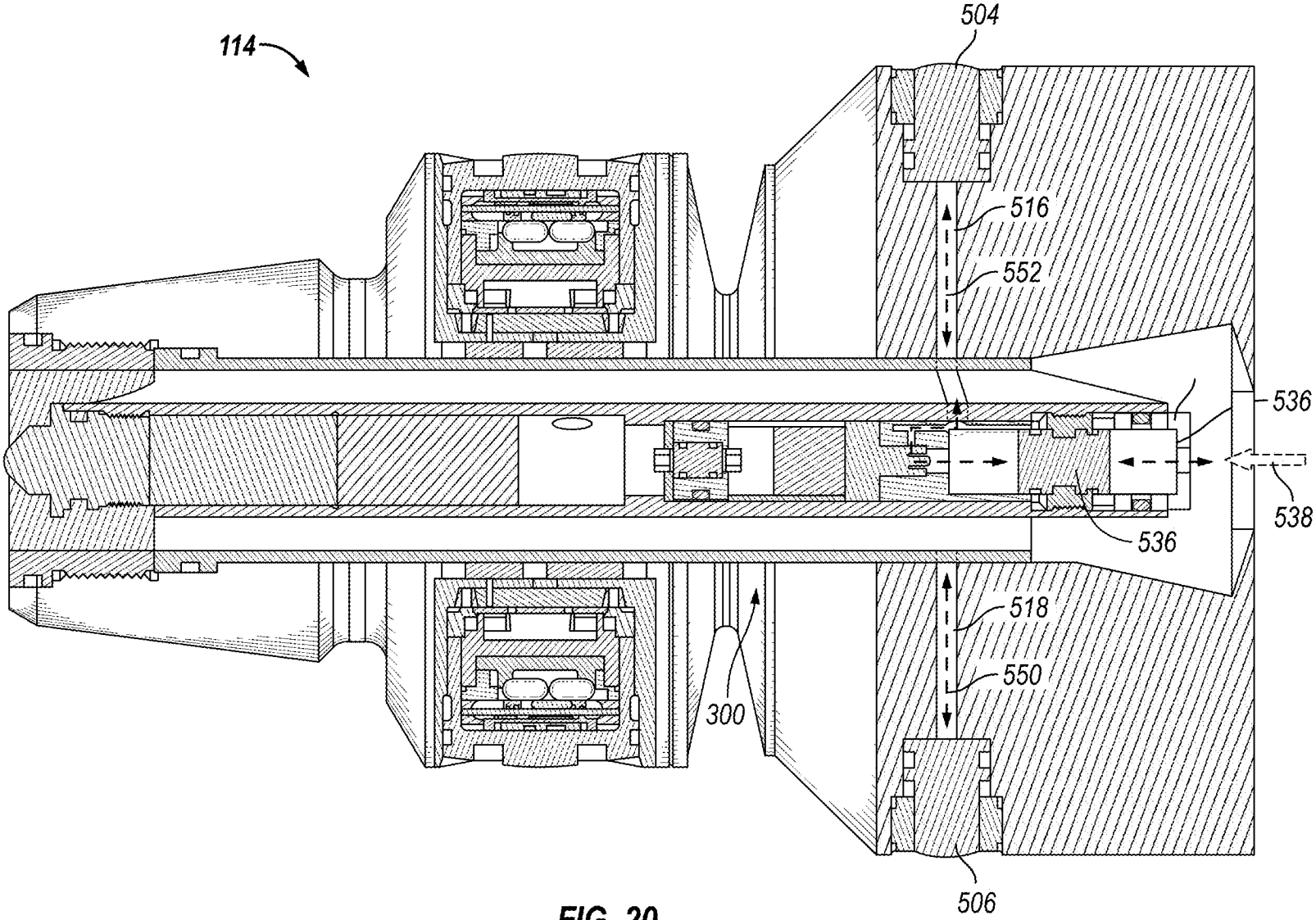

Operation of hydraulic control system 300 of drill bit 114 will now be described with respect to FIGS. 19 and 20. Turning to FIG. 19, the drill bit 114 is shown with no active lock of the moveable elements, such as the first gauge element 504 and second gauge element 506. As illustrated, the solenoid valve 1900 is closed such that pressure port 1904 is isolated from control port 1908 to prevent communication of pressure and fluid through the solenoid valve 1900 to first and second communication channels 516, 518. When desired, for example, in response to measured parameters, hydraulic control system 300 may be activated to open solenoid valve 1900. As shown on FIG. 20, the hydraulic control system 300 may open solenoid valve 1900. With the pressure port 1904 and control port 1908 are fluidically coupled to allow fluid and pressure transmission through the solenoid valve 1900 to first communication channel 516. While the flow paths are not shown, opening of the solenoid valve 1900 may also allow fluid and pressure communication to second communication channel 518. With fluid communication, the fluid in the first and second communication channels 516, 518 may be pressurized such that the fluid is a pressurized fluid 552. As previously described, a differential pressure 538 across the balancing piston 536 may act to increase the pressure. Because the pressurized fluid 552 is in the first and second communication channels 516, 518, the pressure may activate the first and second gauge elements 504, 506. For example, the pressure may act on the first and second gauge elements 504, 506 to provide a biasing pressure, essentially locking them in position. The solenoid valve 1900 may then be closed to lock the pressurized fluid 552 in the first and second communication channels 516, 518. While not shown, the pressure in the first and second communication channels 516, 518 may be released, for example, by opening of the solenoid valve 1900 when the differential pressure 538 has been reduced to less than the pressure of the pressurized fluid 552.

Figure 21:
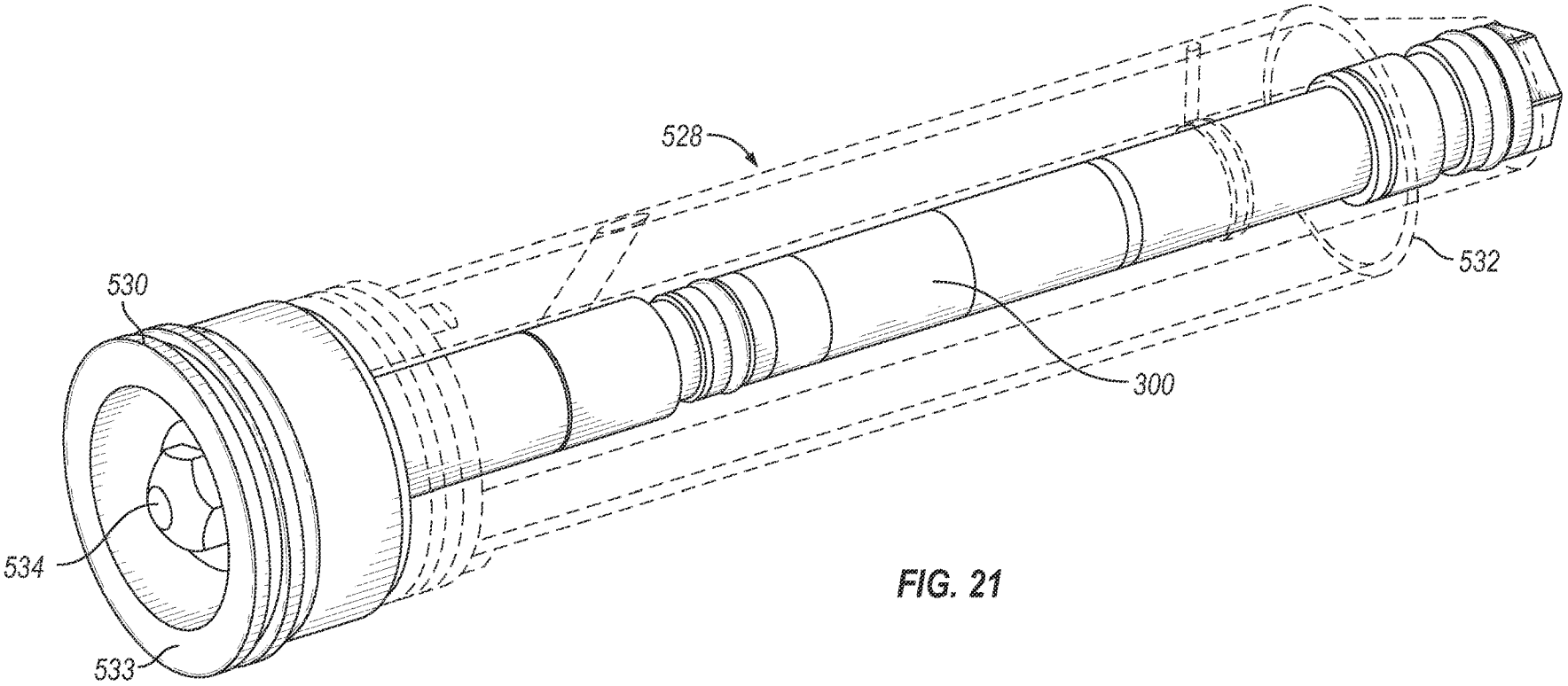
FIG. 21 illustrates a carrier for a hydraulic control system, in accordance with some embodiments of the present disclosure.

FIG. 21 illustrates a carrier 528 for hydraulic control system 300. Carrier 528 may include a proximal carrier end 530 and a distal carrier end 532. In some embodiments, the carrier 528 may be generally cylindrical. At proximal carrier end 530, the carrier 528 may include a cap 534. An additional locking cap 533 may be secured to the proximal carrier end 530 of the carrier over the cap 534. As illustrated, the hydraulic control system 300 may at least partially disposed in the carrier 528.

Accordingly, the present disclosure may provide hydraulic control systems and methods for hydraulically locking and unlocking moveable elements of a drill bit. The systems and methods may include any of the various features disclosed herein, including one or more of the following statements.

Statement 1. A drill bit comprising: a body; a moveable element secured to the body, wherein the moveable element is configured to extend or retract from a surface of the drill bit; a communication channel from the moveable element to a bore in the body; and a hydraulic control system at least partially disposed in the body, wherein the hydraulic control system is configured to at least provide fluid communication from the bore to the communication channel to thereby lock or unlock the moveable element.

Statement 2. The drill bit of Statement 1, wherein drill bit further comprises a plurality of blades extending from the body, each blade having respective cutting elements disposed thereon.

Statement 3. The drill bit of Statement 1 or Statement 2, wherein the drill bit further comprises a blade extending from the body, wherein the blade has respective cutting elements disposed thereon, wherein the moveable element is secured in a pocket of the blade, wherein the moveable element extends or retracts relative to a surface of the blade.

Statement 4. The drill bit of any one of Statements 1 to 3, wherein the moveable element comprises at least one device selected from the group consisting of a gauge element, a depth of cut control element, a moveable blade, and a moveable cutting structure.

Statement 5. The drill bit of any one of Statements 1 to 4, wherein the hydraulic control system comprises an information handling system and a plurality of sensors, wherein the information handling system is configured to actuate the hydraulic control system to at least selectively provide fluid communication from the bore to the communication channel.

Statement 6. The drill bit of Statement 5, wherein the hydraulic control system is configured to at least selectively provide fluid communication from the bore to the communication channel in response to one or more measured parameters from the sensors.

Statement 7. The drill bit of any one of Statements 1 to 6, wherein the hydraulic control system comprises an electric motor to drive a valve element that controls fluid communication from the bore to the communication channel.

Statement 8. The drill bit of Statement 7, wherein the valve element comprises a ported piston valve coupled to the electric motor, wherein the electric motor is configured to linearly drive the ported piston valve within a linear manifold in the bore to selectively couple at least one port in the ported piston valve with the communication channel.

Statement 9. The drill bit of Statement 7, wherein the valve element comprises a ported piston valve coupled to the electric motor, wherein the electric motor is configured to rotationally drive the ported piston valve within a fluid cavity in the bore to selectively couple one or more ports in the ported piston valve with the communication channel.

Statement 10. The drill bit of any one of Statements 1 to 5, wherein the hydraulic control system comprise a motor and a drive screw coupled to the motor, wherein the drive screw is also coupled to a balancing piston, wherein the balancing piston is in fluid communication with a drilling fluid flow passage in the bore on one side and a fluid cavity in the bore on an opposite side, wherein the motor is configured to drive the drive screw to move the balancing piston to pressurize fluid in the fluid cavity and the communication channel, wherein the fluid cavity is in fluid communication with the communication channel.

Statement 11. The drill bit of any one of Statements 1 to 5, wherein the hydraulic control system comprises a lobbed camshaft in a container in the bore, wherein the hydraulic control system comprises two or more ball pistons that are spring loaded, wherein the ball pistons control fluid communication between the container fluid cavity and the communication channel, wherein the ball pistons have a closed position seated in corresponding piston seats in the container, and wherein the ball pistons individually interact with the lobbed camshaft to individually move from the closed position to an open position.

Statement 12. The drill bit of any one of Statements 1 to 5, wherein the hydraulic control system comprises a solenoid valve at least partially disposed in a carrier in the bore that is configured to control fluid communication between at least the bore and communication channel.

Statement 13. The drill bit of any one of Statements 1 to 5, further comprising a second moveable element secured to the body, wherein the second moveable element is configured to extend or retract from the surface of the drill bit; and a second communication channel from the second moveable element to the bore in the body, wherein the hydraulic control system selected provides fluid communication to the moveable element through the communication channel and/or to the second moveable element through the second communication channel.

Statement 14. A method comprising: rotating a drill bit to extend a wellbore into one or more subterranean formations; and controlling pressurization of fluid in a communication channel from a bore in a body of the drill bit to a moveable element to thereby lock or unlock the moveable element.

Statement 15. The method of Statement 14, further comprising measuring one or more parameters with a sensor on the drill bit, wherein the pressurization of the fluid is controlling in response to the one or more parameters.

Statement 16. The method of Statement 14 or Statement 15, further comprising linearly driving a ported piston valve with a linear manifold in the bore to selectively couple a port in the ported piston valve with the communication channel, thereby establishing fluid communication between the communication channel and the bore.

Statement 17. The method of Statement 14 or Statement 15, further comprising rotating a ported piston valve with a rotary manifold in the bore to selectively couple a port in the ported piston valve with the communication channel, thereby establishing fluid communication between the communication channel and the bore.

Statement 18. The method of Statement 14 or Statement 15, wherein the communication channel is in fluid communication with a fluid cavity in a container in the bore, wherein a balancing piston is disposed in the container and is in in fluid communication with the bore on one side and the fluid cavity in the bore on an opposite side, wherein the method further comprises operating a motor to move the balancing piston to pressurize fluid in the fluid cavity and thus pressuring the fluid in the communication channel.

Statement 19. The method of Statement 14 or Statement 15, further comprising rotating a lobbed camshaft to move a ball piston to an open position, thus allowing fluid communication between the communication channel and a container in the bore.

Statement 20. The method of Statement 14 or Statement 15, further comprising actuating a solenoid valve to control the pressurization in the communication channel.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A drill bit comprising:

a body:

a moveable element secured to the body, wherein the moveable element is configured to extend or retract from a surface of the drill bit:

a communication channel from the moveable element to a bore in the body; and a hydraulic control system at least partially disposed in the body, wherein the hydraulic control system is configured to at least provide fluid communication from the bore to the communication channel to thereby lock or unlock the moveable element, wherein the hydraulic control system comprises an electric motor to drive a valve element that control fluid communication from the bore to the communication channel, wherein the valve element comprises a ported piston valve coupled to the electric motor, wherein the electric motor is configured to linearly drive or rotationally drive the ported piston valve within a fluid cavity in the more to selectively couple one or more ports in the ported piston valve with the communication channel.

2. The drill bit of claim 1, wherein drill bit further comprises a plurality of blades extending from the body, each blade having respective cutting elements disposed thereon.

3. The drill bit of claim 1, wherein the drill bit further comprises a blade extending from the body, wherein the blade has respective cutting elements disposed thereon, wherein the moveable element is secured in a pocket of the blade, wherein the moveable element extends or retracts relative to a surface of the blade.

4. The drill bit of claim 1, wherein the moveable element comprises at least one device selected from the group consisting of a gauge element, a depth of cut control element, a moveable blade, and a moveable cutting structure.

5. The drill bit of claim 1, wherein the hydraulic control system comprises an information handling system and a plurality of sensors, wherein the information handling system is configured to actuate the hydraulic control system to at least selectively provide fluid communication from the bore to the communication channel.

6. The drill bit of claim 5, wherein the hydraulic control system is configured to at least selectively provide fluid communication from the bore to the communication channel in response to one or more measured parameters from the sensors.

7. The drill bit of claim 1, wherein the electric motor is configured to linearly drive the ported piston valve.

8. The drill bit of claim 1, wherein the electric motor is configured to rotationally drive the ported piston valve.

9. The drill bit of claim 1, wherein the hydraulic control system comprises a solenoid valve at least partially disposed in a carrier in the bore that is configured to control fluid communication between at least the bore and communication channel.

10. The drill bit of claim 1, further comprising a second moveable element secured to the body, wherein the second moveable element is configured to extend or retract from the surface of the drill bit; and a second communication channel from the second moveable element to the bore in the body, wherein the hydraulic control system selected provides fluid communication to the moveable element through the communication channel and/or to the second moveable element through the second communication channel.

11. A drill bit comprising:

a body;

a moveable element secured to the body, wherein the moveable element is configured to extend or retract from a surface of the drill bit;

a communication channel from the moveable element to a bore in the body; and a hydraulic control system at least partially disposed in the body, wherein the hydraulic control system is configured to at least provide fluid communication from the bore to the communication channel to thereby lock or unlock the moveable element, wherein the hydraulic control system comprise a motor and a drive screw coupled to the motor, wherein the drive screw is also coupled to a balancing piston, wherein the balancing piston is in fluid communication with a drilling fluid flow passage in the bore on one side and a fluid cavity in the bore on an opposite side, wherein the motor is configured to drive the drive screw to move the balancing piston to pressurize fluid in the fluid cavity and the communication channel, wherein the fluid cavity is in fluid communication with the communication channel.

12. A drill bit comprising:

a body;

a moveable element secured to the body, wherein the moveable element is configured to extend or retract from a surface of the drill bit;

a communication channel from the moveable element to a bore in the body; and a hydraulic control system at least partially disposed in the body, wherein the hydraulic control system is configured to at least provide fluid communication from the bore to the communication channel to thereby lock or unlock the moveable element, wherein the hydraulic control system comprises a lobbed camshaft in a container in the bore, wherein the hydraulic control system comprises two or more ball pistons that are spring loaded, wherein the ball pistons control fluid communication between the container fluid cavity and the communication channel, wherein the ball pistons have a closed position seated in corresponding piston seats in the container, and wherein the ball pistons individually interact with the lobbed camshaft to individually move from the closed position to an open position.

13. The drill bit of claim 12, wherein the hydraulic control system comprises an information handling system and a plurality of sensors, wherein the information handling system is configured to actuate the hydraulic control system to at least selectively provide fluid communication from the bore to the communication channel, wherein the hydraulic control system is configured to at least selectively provide fluid communication from the bore to the communication channel in response to one or more measured parameters from the sensors.

14. A method comprising:

rotating a drill bit to extend a wellbore into one or more subterranean formations; and controlling pressurization of fluid in a communication channel from a bore in a body of the drill bit to a moveable element to thereby lock or unlock the moveable element, wherein the method further comprises: linearly driving or rotationally driving a ported piston valve with a linear or rotary manifold in the bore to selectively couple a port in the ported piston salve with the communication channel, thereby establishing fluid communication between the communication channel and the bore.

15. The method of claim 14, further comprising measuring one or more parameters with a sensor on the drill bit, wherein the pressurization of the fluid is controlling in response to the one or more parameters.

16. The method of claim 14, wherein the ported piston valve is linearly driving with the linear manifold.

17. The method of claim 14, wherein the ported piston valve is rotationally driven with the rotary manifold.

18. The method of claim 14, further comprising actuating a solenoid valve to control the pressurization in the communication channel.

19. A method comprising:

rotating a drill bit to extend a wellbore into one or more subterranean formations; and control pressurization of fluid in a communication channel from a bore in a body of the drill bit to a moveable element to thereby lock or unlock the moveable element, wherein the communication channel is in fluid communication with a fluid cavity in a container in the bore, wherein a balancing piston is disposed in the container and is in in fluid communication with the bore on one side and the fluid cavity in the bore on an opposite side, wherein the method further comprises operating a motor to move the balancing piston to pressurize fluid in the fluid cavity and thus pressuring the fluid in the communication channel.

20. A method comprising:

rotating a drill bit to extend a wellbore into one or more subterranean formations; and control pressurization of fluid in a communication channel from a bore in a body of the drill bit to a moveable element to thereby lock or unlock the moveable element wherein the method further comprises rotating a lobbed camshaft to move a ball piston to an open position, thus allowing fluid communication between the communication channel and a container in the bore.

* * * * *